US010301058B2

(12) United States Patent
Makiuchi et al.

(10) Patent No.: US 10,301,058 B2
(45) Date of Patent: May 28, 2019

(54) LOCKING STRUCTURE, CONTAINER UTILIZING LOCKING STRUCTURE, AND CONTAINER ASSEMBLING APPARATUS

(71) Applicant: Rengo Co., Ltd., Osaka (JP)

(72) Inventors: Takafumi Makiuchi, Kawaguchi (JP); Noriyoshi Azuma, Tosu (JP); Haruhiko Yamada, Saitama (JP); Takahiro Okuda, Matsudo (JP); Tokimasa Kuroda, Kawaguchi (JP); Yoichi Nishikawa, Adachi-ku (JP)

(73) Assignee: RENGO CO., LTD., Osaka (JP)

( * ) Notice: Subject to any disclaimer, the term of this patent is extended or adjusted under 35 U.S.C. 154(b) by 41 days.

(21) Appl. No.: 15/101,881

(22) PCT Filed: Nov. 17, 2014

(86) PCT No.: PCT/JP2014/080330
§ 371 (c)(1),
(2) Date: Jun. 3, 2016

(87) PCT Pub. No.: WO2015/087660
PCT Pub. Date: Jun. 18, 2015

(65) Prior Publication Data

US 2016/0368652 A1 Dec. 22, 2016

(30) Foreign Application Priority Data

Dec. 10, 2013 (JP) ..... 2013-255193
May 26, 2014 (JP) ..... 2014-108307

(51) Int. Cl.
*B65D 5/00* (2006.01)
*B65D 5/20* (2006.01)
(Continued)

(52) U.S. Cl.
CPC ..... *B65D 5/0045* (2013.01); *B65D 5/003* (2013.01); *B65D 5/0025* (2013.01);
(Continued)

(58) Field of Classification Search
CPC ..... B65D 5/0045; B65D 5/003; B65D 5/443; B65D 5/001; B65D 5/0254; B31B 3/50; B31B 2203/084; B31B 2203/105
(Continued)

(56) References Cited

U.S. PATENT DOCUMENTS

2013/0153648 A1* 6/2013 Smith ..... B65D 5/42 229/108

FOREIGN PATENT DOCUMENTS

JP 52-009574 A 1/1977
JP S53-011902 4/1978
(Continued)

*Primary Examiner* — Christopher R Demeree
(74) *Attorney, Agent, or Firm* — BakerHostetler

(57) ABSTRACT

A locking receiving portion is defined by a first inclined line extending toward a third panel side on a first panel from a branching point on a fold line between the first panel and a second panel, a second inclined line extending toward the third panel side on the second panel from the branching point, and a cut portion extending between a distal end of the first inclined line and a distal end of the second inclined line. The locking receiving portion extends in an inclined manner between the first panel and the second panel in an assembled state. A locking portion is formed on the third panel, and configured to be locked to a cut portion side of the locking receiving portion in an assembled state.

7 Claims, 20 Drawing Sheets

(51) Int. Cl.

| | |
|---|---|
| ***B65D 5/30*** | (2006.01) |
| ***B65D 5/36*** | (2006.01) |
| *B31B 50/81* | (2017.01) |
| *B31B 120/30* | (2017.01) |
| *B31B 50/78* | (2017.01) |
| *B31B 100/00* | (2017.01) |
| *B31B 120/00* | (2017.01) |

(52) U.S. Cl.
CPC ..... *B65D 5/2047* (2013.01); *B65D 5/30* (2013.01); *B65D 5/3671* (2013.01); *B31B 50/784* (2017.08); *B31B 50/81* (2017.08); *B31B 2100/0024* (2017.08); *B31B 2120/30* (2017.08); *B31B 2120/502* (2017.08)

(58) Field of Classification Search
USPC .... 229/192, 174, 918, 919, 170, 198.1, 915, 229/190, 186; 206/512
See application file for complete search history.

(56) References Cited

FOREIGN PATENT DOCUMENTS

| | | | |
|---|---|---|---|
| JP | 60-115816 | | 8/1985 |
| JP | 62-093020 | | 6/1987 |
| JP | 2001-354229 | A | 12/2001 |
| JP | 2002-103480 | A | 4/2002 |
| WO | WO 2011/137023 | A1 | 11/2011 |

* cited by examiner

LOCKING STRUCTURE, CONTAINER UTILIZING LOCKING STRUCTURE, AND CONTAINER ASSEMBLING APPARATUS

CROSS-REFERENCE TO RELATED APPLICATIONS

This is a national phase application in the United States of International Patent Application No. PCT/JP2014/080330, with an international filing date of Nov. 17, 2014, which claims priority of Japanese Patent Application Nos.: 2013-255193 filed on Dec. 10, 2013, and 2014-108307 filed on May 26, 2014, the contents of which are incorporated herein by reference in their entireties.

TECHNICAL FIELD

The present invention relates to a locking structure for maintaining a paper product in an assembled state, a tray-shaped container using the locking structure, and an apparatus for automatically assembling the container.

BACKGROUND ART

Japanese Patent No. 4515601 discloses a cardboard-made tray provided with closure flaps which cover a portion of an upper end opening of a tray body. In such a tray, fruits or vegetables are stored in the tray body in a state where the closure flaps are outwardly inclined. After the fruits or vegetables are stored, the closure flaps are folded in a horizontal direction, and inserting projections of locking pieces formed on both side edges of the closure flaps are inserted into insertion holes formed in the tray body, thus assembling the tray.

However, in assembling the tray disclosed in Japanese Patent No. 4515601, it is necessary to hold the closure flaps and the locking pieces, and to position and insert the inserting members of the locking pieces into the insertion holes with an operator's fingers while maintaining such a state, complexing an assembling operation. Further, it is extremely difficult to automatically assemble such a tray which requires a complex assembling operation using an apparatus, and the apparatus requires a complicated mechanism so that a cost is pushed up.

SUMMARY

Problems to be Solved

It is an object of the present invention to provide a locking structure and a container which have excellent assembling operability and enable an automatic assembling of the container using an apparatus. It is also an object of the present invention to provide an apparatus for assembling a container utilizing the locking structure of the present invention.

Means for Solving the Problems

In order to solve the above-problems, a locking structure according to the present invention comprises a first panel, a second panel formed continuously with the first panel and folded against the first panel, and a third panel arranged along an inner surface of the second panel. The container further comprises a first inclined line extending toward a third panel side on the first panel from a branching point on a fold line between the first panel and the second panel, and inclined with respect to the fold line, a second inclined line extending toward the third panel side on the second panel from the branching point and inclined with respect to the fold line, a cut portion extending between a distal end of the first inclined line and a distal end of the second inclined line, a locking receiving portion defined by the first inclined line, the second inclined line, and the cut portion, and extending in an inclined manner between the first panel and the second panel in an assembled state, and a locking portion formed on the third panel, and locked to a cut portion side of the locking receiving portion by assembling the third panel so that the third panel extends along an inner surface of the second panel. The folding line between the first and second inclined lines does not encompass a folding line provided entirely along a boundary portion between the first panel and the second panel. The first and second inclined lines encompass both of a straight score and a curved score. The first and second inclined lines encompass a combination of two or more straight lines and curved lines.

A container to which the locking structure is applied comprises a first panel, a second panel formed continuously with the first panel and folded against the first panel, and a third panel arranged along an inner surface of the second panel. The container further comprises a first inclined line extending toward a third panel side on the first panel from a branching point on a fold line between the first panel and the second panel, and inclined with respect to the fold line, a second inclined line extending toward the third panel side on the second panel from the branching point and inclined with respect to the fold line, a cut portion extending between a distal end of the first inclined line and a distal end of the second inclined line, a locking receiving portion defined by the first inclined line, the second inclined line, and the cut portion, and extending in an inclined manner between the first panel and the second panel in an assembled state, and a locking portion formed on the third panel, and locked to a cut portion side of the locking receiving portion by assembling the third panel so that the third panel extends along an inner surface of the second panel.

In the present invention, when the second panels are folded against the first panel, the locking receiving portion defined by the first and second inclined lines and the cut portion is raised stereoscopically against the first panel and the second panels. Accordingly, by merely arranging the third panel along the second panel, the locking portion of the third panel can be easily locked to the locking receiving portion and hence, assembling operability can be enhanced. Further, because of this locking structure, a complex and high-accuracy positioning operation is unnecessary and hence, automatic assembling of the container using an apparatus can be realized.

The container is preferably configured so that a cutout portion which is disposed adjacently to a cut portion side of the locking receiving portion and into which a corner portion of the third panel falls at the time of assembling is provided, and a portion of the cut portion is formed by an edge of the cutout portion. With such a configuration, the corner portion of the third panel is made to fall into the cutout portion in locking the locking portion to the locking receiving portion so that it is possible to prevent the corner portion of the third panel from interfering with the first panel whereby the locking portion can be easily locked to the locking receiving portion.

The specific configuration of the container is so that the container includes: a bottom panel which forms the first panel; a pair of side panels which forms the second panels connected to two sides of the bottom panel arranged opposite to each other; a pair of end panels connected to two other sides of the bottom panel arranged opposite to each other; closure flaps connected to the end panels and covering a portion of an upper end formed of the side panels and the end panels in an assembled state; and a locking piece formed of the third panel connected to the closure flaps, wherein the locking piece is arranged on an inner surface of the side panel by folding the closure flaps against the end panel in a state that the locking piece is folded against the closure flaps, and the locking piece is locked by rotating the locking portion toward a cut portion side of the locking receiving portion. In the container, when the locking piece is folded against the closure flap, an elastic restoring force acts on the locking lug due to rigidity (stiffness) of the locking piece. Accordingly, by merely folding the by pushing the closure flap, the locking piece is brought into slide contact with the inner surface of the side panel, and the locking portion is rotated toward and is locked to the locking receiving portion and hence, assembling operability can be further enhanced.

Further a container assembling apparatus for assembling the container comprises a bottom panel which forms the first panel, a pair of side panels which forms the second panel connected to two sides of the bottom panel arranged opposite to each other, a pair of end panels connected to two other sides of the bottom panel arranged opposite to each other, a closure flap connected to the end panels and covering a portion of an upper end formed of the side panels and the end panels in an assembled state, and a locking piece formed of the third panel and connected to the closure flaps. The locking piece is arranged on an inner surface of the side panel by folding the closure flap against the end panel in a state that the locking piece is folded against the closure flap, and the locking portion is locked by rotating the locking portion toward a cut portion side of the locking receiving portion.

The container assembling apparatus includes the positioning member which performs the positioning of the locking piece and hence, it is possible to prevent the occurrence of a state where the locking piece interferes with an end edge of the side panel due to an action of an elastic restoring force so that the locking piece cannot be arranged on an inner surface side of the side panel. Further, when the closure flap is rotated by the swing member, a distal end of the locking piece is arranged on the inner surface side of the side panel and, thereafter, the positioning of the locking piece by the positioning member is released, and the locking piece is rotated while being brought into slide contact with the inner surface of the side panel. Then, due to the rotation of the closure flap by the swing member, the locking piece is rotated to a predetermined position and is locked at the predetermined position. Accordingly, the container can be automatically assembled with certainty.

The container assembling apparatus further includes a receiving member movably arranged on a bottom side of the guide frame and receiving a bottom surface side of the bottom panel. With such a configuration, a force generated by the swing member can prevent the movement of the container and hence, the assembly can be certainly completed.

Effect of the Disclosure

In the locking structure of the present invention, when the second panels (side panels) are folded against the first panel (bottom panel), the locking receiving portion defined by the first and the second inclined lines and the cut portion is raised stereoscopically against the first panel and the second panels. Accordingly, by merely arranging the third panel (locking piece) along the second panel, the locking portion of the third panel can be easily locked to the locking receiving portion. In the container utilizing such a locking structure, by rotating the closure flap, the locking piece (third panel) on which an elastic restoring force acts is rotated while being brought into slide contact with an inner surface of the side panel (second panel) and hence, the locking portion can be easily and surely locked to the raised locking receiving portion. In the container assembling apparatus, positioning of the locking piece on the inner surface side of the side panel is performed by the positioning member and hence, in rotating the closure flap by the swing member, it is possible to prevent the locking piece from interfering with the end edge of the side panel. Accordingly, automatic container assembling by the apparatus can be certainly realized.

DETAILED DESCRIPTION

Hereinafter, embodiments of the present invention are described with reference to drawings.

First Embodiment

Figure 1:
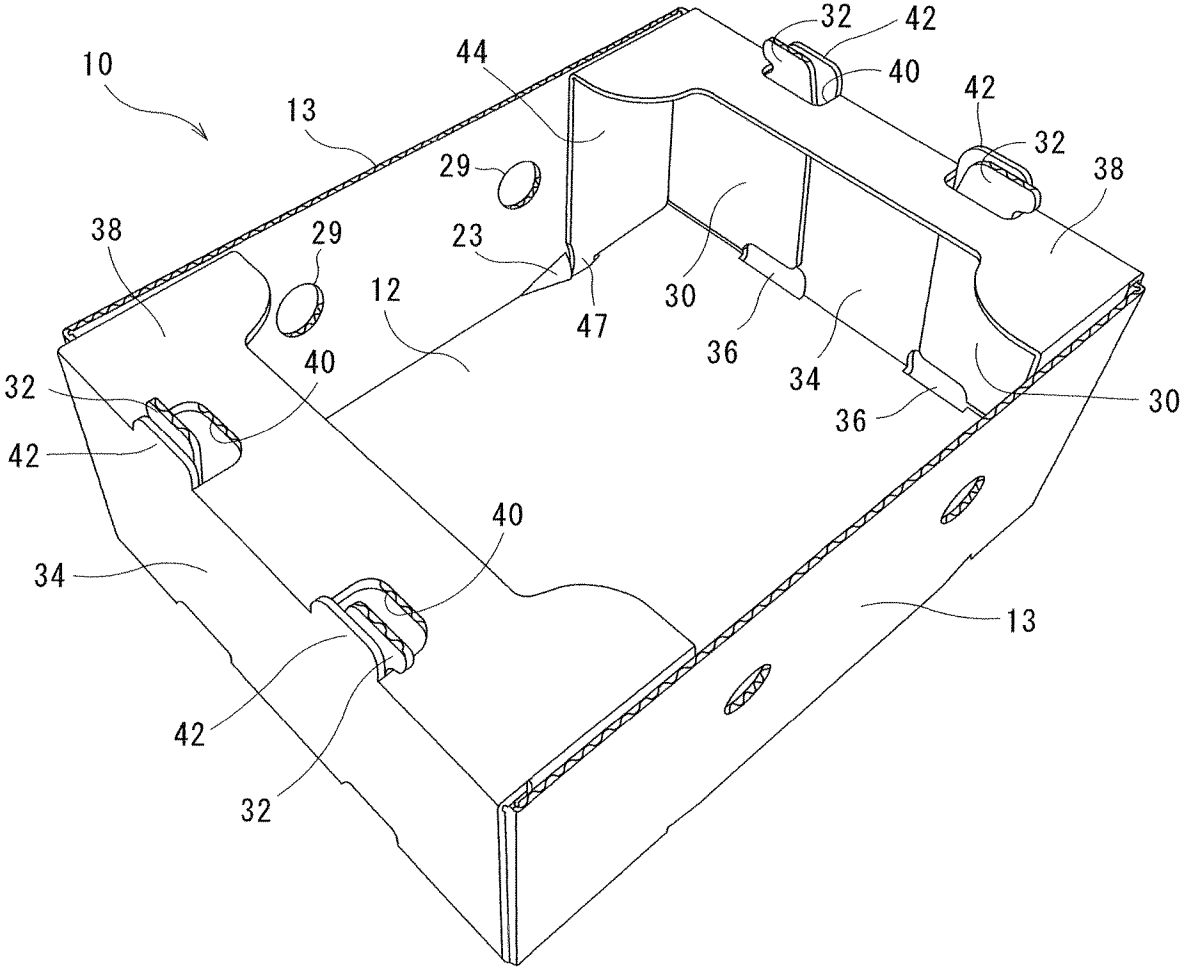
FIG. 1 is a perspective view of a container according to a first embodiment of the present invention.

FIG. 1 shows a tray 10 of a first embodiment formed using a corrugated paper board and having a locking structure of the present invention. The tray 10 forming a container is a box which includes: a bottom panel (first panel) 12; side panels (second panels) 13; and end panels 34. An upper end of the tray 10 is opened, and portions of an upper end opening are partially covered by closure flaps 38. The corrugated paper board has a well-known structure where a corrugated-shaped intermediate core is disposed between a front liner and a back liner.

Figure 2:
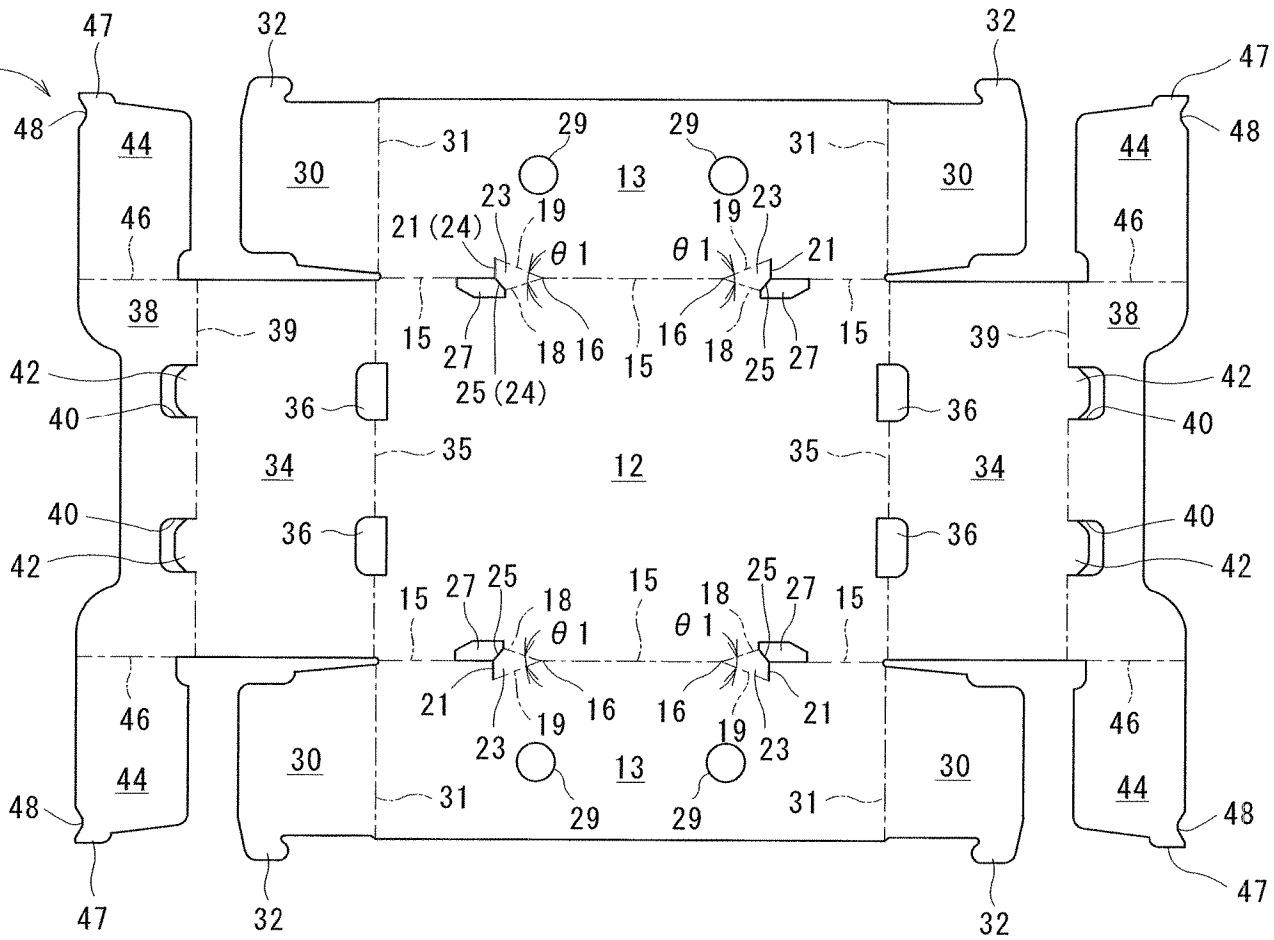
FIG. 2 is a developed view of the container in FIG. 1.

As shown in FIG. 2, a pair of side panels 13, 13 is connected to long sides (two sides opposite to each other) of the rectangular bottom panel 12, and a pair of end panels 34, 34 is connected to short sides (two sides opposite to each other) of the rectangular bottom panel 12.

The side panels 13 have a rectangular plate shape, are formed continuously with the bottom panel 12, and are folded against the bottom panel 12 at a right angle in an assembled state. Circular ventilation holes 29 through which air is exchanged between an inside and an outside of the tray 10 are formed in the side panels 13. A side-panel fold line (first fold line) 15, locking receiving portions 23, and cutout portions 27 are formed on each boundary portion between the bottom panel 12 and the side panel 13. The fold line is formed of a general score line which is formed on a corrugated paper board by forming scores from a back liner side so as to reduce a panel thickness of the corrugated paper board by compression.

The side-panel fold line 15 is linearly formed on the boundary portion between the bottom panel 12 and the side panel 13 at portions excluding the locking receiving portions 23 and the cutout portions 27. The side-panel fold line 15 is formed between a corner of the bottom panel 12 and the cutout portion 27 and between branching points 16, 16 of a pair of locking receiving portions 23, 23.

The locking receiving portion 23 is formed of an inner region having a quadrangular shape which is surrounded by a bottom-panel-side inclined fold line (first inclined line) 18, a side-panel-side inclined fold line (second inclined line) 19, and cut portions 24. The locking receiving portion 23 extends in an inclined manner between the bottom panel 12 and the side panel 13 in a state where the tray 10 is assembled. The pair of locking receiving portions 23, 23 is arranged along the side-panel fold line 15 with a predetermined distance therebetween. The locking receiving portions 23 are formed so that a width of the locking receiving portions 23 is increased from the branching point 16 positioned on the side-panel fold line 15 toward a locking piece 44 described later positioned closest to the branching point 16. The branching points 16 are disposed on a center side of the side-panel fold line 15 positioned between the locking pieces 44, 44 disposed at both ends of the tray 10 in the assembled state. The locking receiving portions 23 are formed so as to expand outward from the branching points 16.

The bottom-panel-side inclined fold line 18 extends on the bottom panel 12 from the branching point 16, and is inclined so as to intersect with the side-panel fold line 15. The bottom-panel-side inclined fold line 18 extends toward a closure flap 38 (locking piece 44) disposed at a position closest to the branching point 16 (outside) out of the pair of closure flaps 38, 38 positioned at both ends of the tray 10 in the assembled state.

The side-panel-side inclined fold line 19 extends on the side panel 13 from the branching point 16, and is inclined so as to intersect with a side-panel fold line 15. The side-panel-side inclined fold line 19 extends toward a locking piece 44 disposed at a position closest to the branching point 16 (outside) out of the pair of locking pieces 44, 44 positioned at both ends of the tray 10 in the assembled state.

An angle (formed angle) θ1 formed between the side-panel-side inclined fold line 19 and the bottom-panel-side inclined fold line 18 is set to smaller than 180 degrees, and is preferably set to an angle which falls within a range from 20 degrees to 90 degrees. When the angle θ1 is set to 180 degrees, the locking receiving portion 23 cannot be raised from the bottom panel 12 and side panel 13 in the assembled state. When the angle θ1 is set to larger than 180 degrees, the locking receiving portion 23 extends in a reverse direction so that the locking piece 44 cannot be locked to the locking receiving portion 23. When the angle θ1 is set to smaller than 20 degrees, an amount by which the locking receiving portion 23 is raised inwardly (locking space) becomes small and hence, assembling operability is deteriorated. When the angle θ1 is set to larger than 90 degrees, an amount by which the locking receiving portion 23 is raised inwardly becomes excessively large and hence, the locked locking piece 44 is easily disengaged from the locking receiving portion 23.

In this embodiment, the angle θ1 formed between the bottom-panel-side inclined fold line 18 and the side-panel-side inclined fold line 19 is set to 40 degrees. In this case, for example, an angle formed between the side-panel-side inclined fold line 19 and an extension (not shown in the drawing) of the side-panel fold line 15 extending inside the locking receiving portion 23 is set to 22 degrees, and an angle formed between the bottom-panel-side inclined fold line 18 and the extension is set to 18 degrees. In this manner, instead of forming the inclined fold lines 18, 19 line-symmetrically with respect to the side-panel fold line 15, the inclination angle of the side-panel-side inclined fold line 19 is set to a large angle, thus ensuring a locking space in the vertical direction.

The cut portion 24 is formed of the cut line 21 and a cutout edge 25 of the cutout portion 27, and extends between a distal end of the bottom-panel-side inclined fold line 18 and a distal end of the side-panel-side inclined fold line 19. The cut line 21 is formed on the side panel 13, and extends in a direction orthogonal to the side-panel fold line 15 between the distal end of the side-panel-side inclined fold line 19 and the side-panel fold line 15. By forming the cutout portion 27 on the bottom panel 12, the cutout edge 25 is formed of an edge of an inclined portion of the cutout portion 27. The cutout edge 25 is formed between an end portion of the cut line 21 on a bottom panel 12 and the distal end of the bottom-panel-side inclined fold line 18. The cutout edge 25 is bent (inclined) toward the branching point 16 with respect to the cut line 21. In the state where the tray 10 is assembled, the cut portion 24 is separated from the side panel 13 and the bottom panel 12.

The cutout portion 27 is formed on the boundary portion between the bottom panel 12 and the side panel 13 on the bottom panel 12 side along the side-panel fold line 15. The cutout portion 27 has a hexagonal shape, and is disposed adjacently to the locking receiving portion 23. One side of the cutout portion 27 which is disposed adjacently to the locking receiving portion 23 forms the cutout edge 25 of the locking receiving portion 23. The cutout portion 27 is formed to have a profile size which allows a locking lug (corner portion) 47 described later to fall into the cutout portion 27 in the assembled state.

Folding flaps 30 disposed along inner surfaces of the end panels 34 in the assembled state are connected to both end edges of the side panel 13. A folding flap fold line 31 is formed on each boundary portion between the side panel 13 and the folding flap 30. An insertion lug 32 which projects upward in the assembled state is formed at an outer corner portion of the folding flap 30.

The end panel 34 has a rectangular plate shape, and an end-panel fold line 35 and stacking holes 36 are formed on each boundary portion between the bottom panel 12 and the end panel 34. The end-panel fold line 35 is formed on the boundary portion between the bottom panel 12 and the end panel 34 at portions excluding the stacking holes 36. The stacking holes 36 are respectively formed of an approximately rectangular hole, and are formed over an area ranging from the bottom panel 12 to the end panel 34.

The closure flap 38 is connected to an end edge of the end panel 34 on a side opposite to the bottom panel 12. The closure flap 38 extends inward from an upper end of the end panel 34 in a horizontal direction in the assembled state, and is arranged so as to cover a portion of the upper end opening of the tray 10. The closure flap 38 is formed so as to extend between both side panels 13, 13, thus allowing the tray 10 to be stacked in a stable state at the time of transportation. A closure-flap fold line (second fold line) 39, insertion holes 40, and stacking projections 42 are formed on each boundary portion between the end panel 34 and the closure flap 38. The closure-flap fold line 39 is formed on the boundary portion at portions excluding regions where the stacking projections 42 are formed. The insertion holes 40 are respectively formed of a rectangular hole formed on a closure flap 38 side along the closure-flap fold line 39. The stacking projection 42 used for stacking the tray 10 is formed inside the insertion hole 40, and integrally projects from an end edge of the end panel 34 toward the closure flap 38.

The locking pieces (third panels) 44 which are arranged along an inner surface of the side panel 13 in an assembled state are connected to both outer edges of the closure flap 38. A locking-piece fold line 46 is formed on each boundary portion between the closure flap 38 and the locking piece 44. A locking lug 47 which projects outwardly is formed on an outer corner portion of the locking piece 44. The locking lug 47 is locked to a cut portion 24 side of the locking receiving portion 23 in the assembled state. The locking lug 47 defines a locking recessed portion (locking portion) 48 formed on an outer end edge of the locking piece 44, and positioned on a locking receiving portion 23 side in the assembled state.

Figure 3:
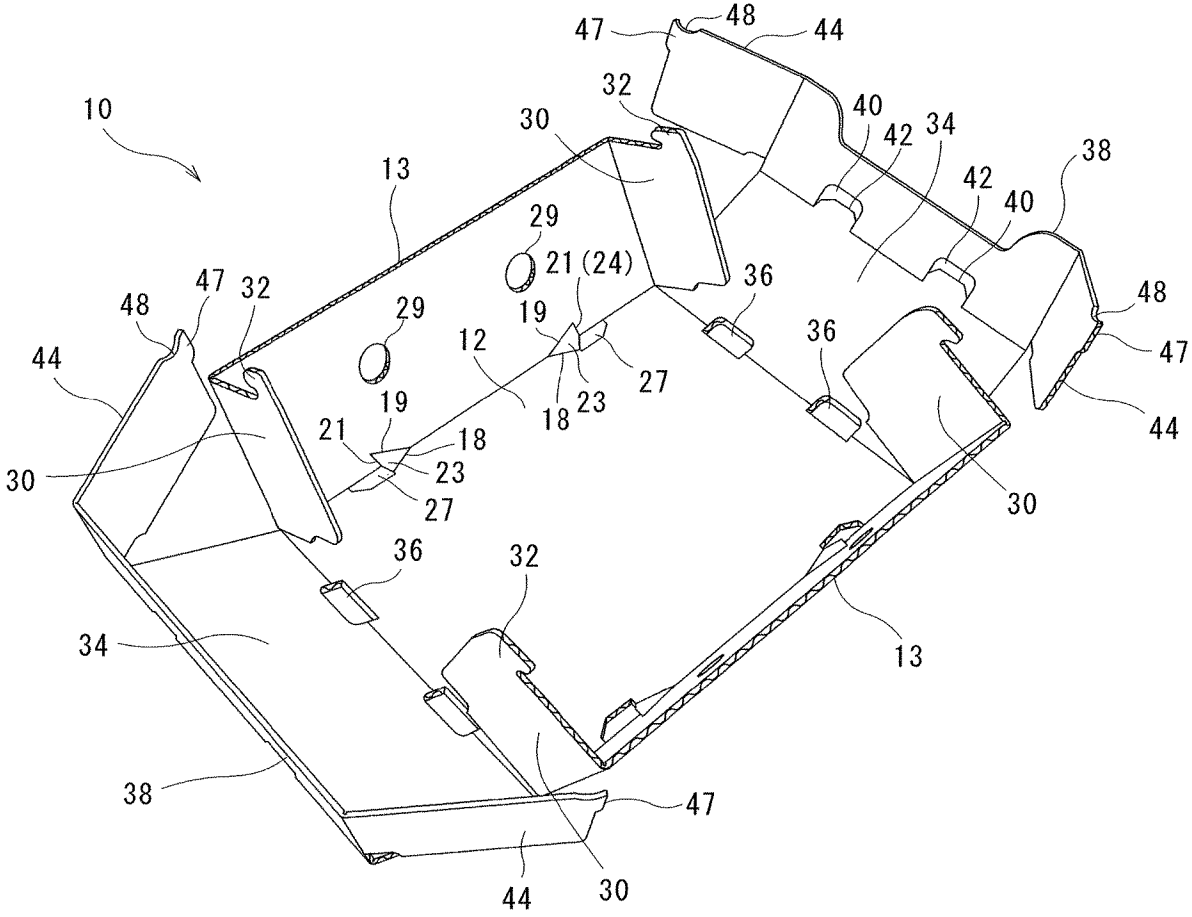
FIG. 3 is a perspective view of the container before the container is assembled.

In assembling the tray 10 formed of the blank, firstly, as shown in FIG. 3, the side panels 13 are folded so as to raise the side panels 13 against the bottom panel 12, and the folding flaps 30 are folded inwardly against the side panels 13. When the side panels 13 are folded, the cut lines 21 are separated from the side panels 13, and the locking receiving portions 23 are stereoscopically raised against the bottom panel 12 and the side panels 13 thus exposing the cut portions 24.

Figure 4:
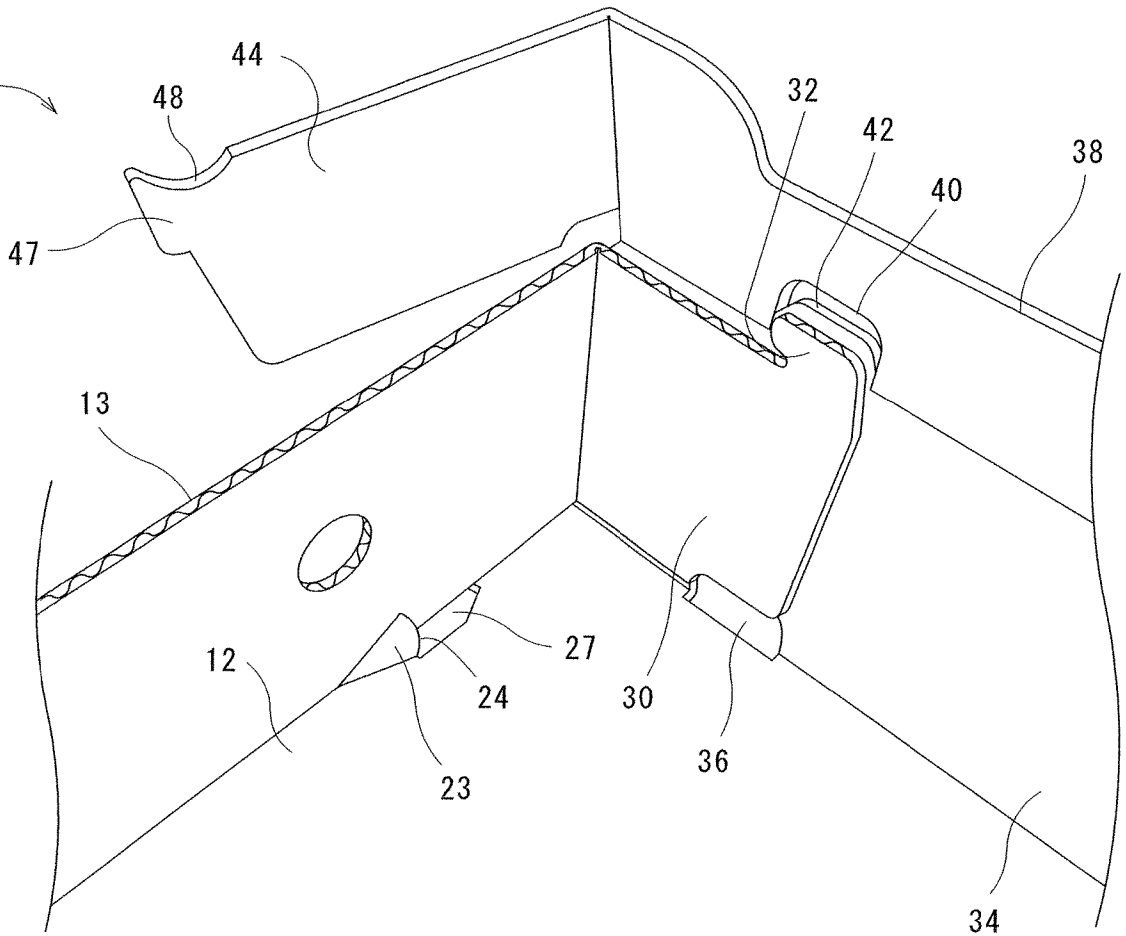
FIG. 4 is a partial enlarged perspective view showing a locking piece and a locking receiving portion in the course of assembling the container.

Next, the end panels 34 are folded so as to raise the end panels 34 against the bottom panel 12, and the locking pieces 44 are folded inwardly against the end panels 34. Then, as shown in FIG. 4, the end panels 34 are held in a raised state where the end panels 34 are arranged along outer surfaces of the folding flaps 30. At this stage of operation, the insertion lug 32 of the folding flap 30 and the stacking projection 42 are made to agree with each other. Further, due to elastic fore of the blank (rigidity (stiffness) of a corrugated paper board), an elastic restoring force toward the outside of the side panel 13 acts on the locking piece 44.

Figure 5:
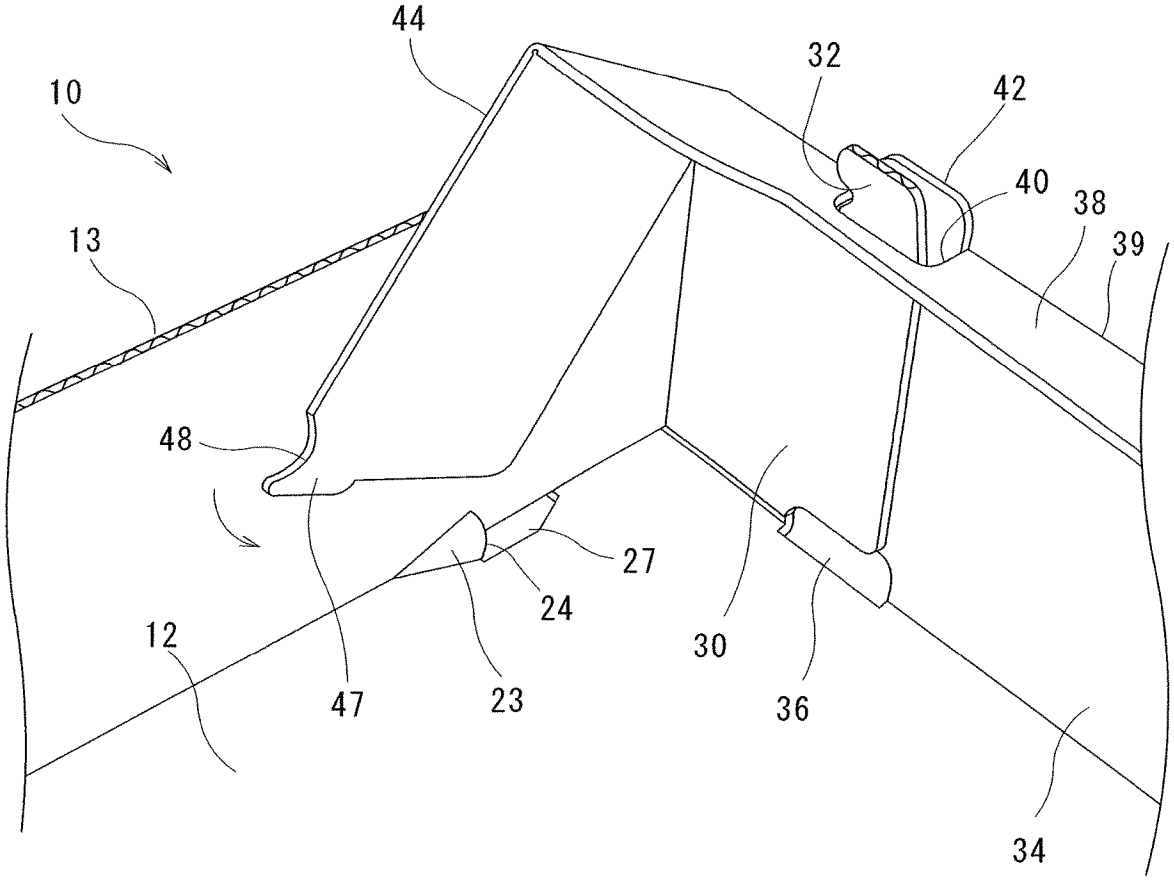
FIG. 5 is a partial enlarged perspective view showing the locking piece and the locking receiving portion in the course of assembling the container.

Then, as shown in FIG. 5, each locking piece 44 is folded inwardly against the elastic restoring force so as to be positioned on the inner surface of the side panel 13, and is rotated toward the bottom panel 12 about the closure-flap fold line 39 by pushing the closure flap 38. Due to such operations, the locking lug 47 is rotated toward the locking receiving portion 23 while the locking piece 44 is brought into contact with the inner surface of the side panel 13.

Figure 6:
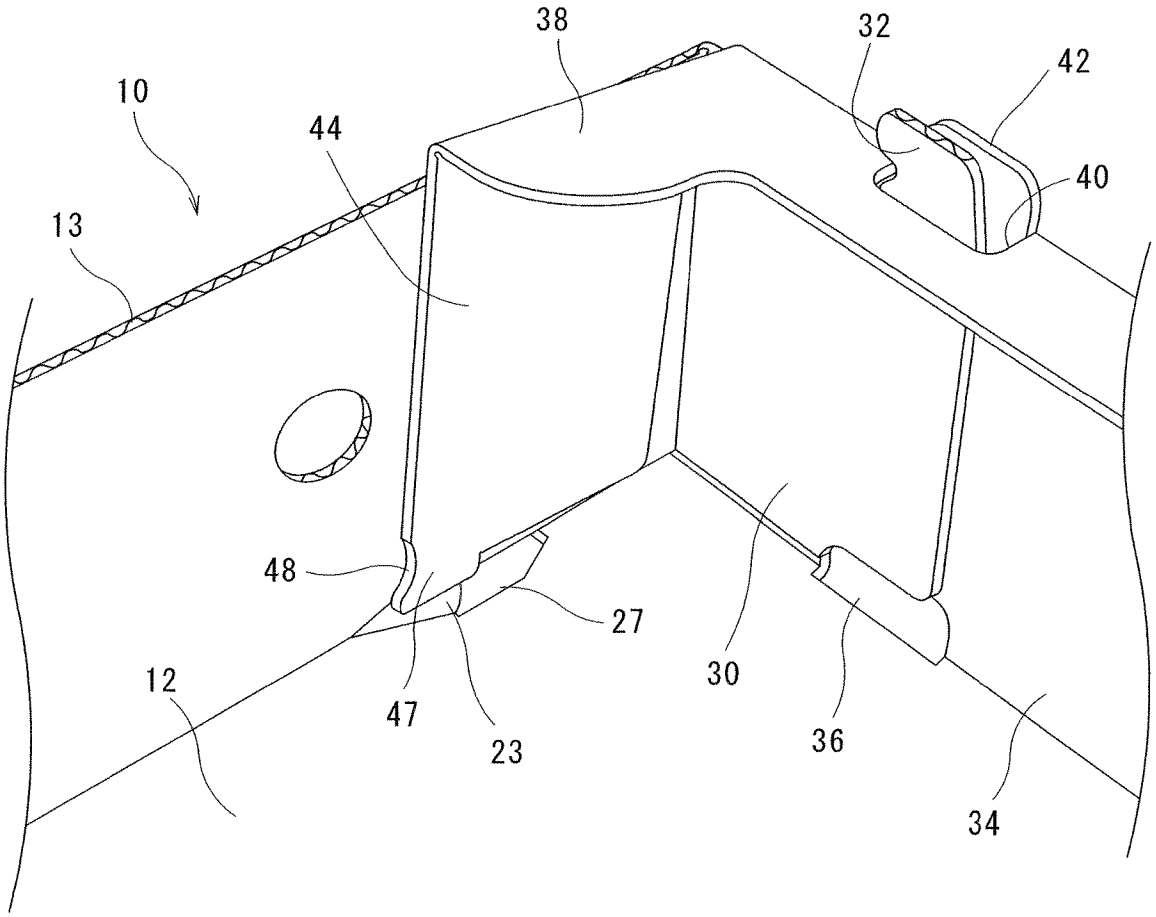
FIG. 6 is a partial enlarged perspective view showing the locking piece and the locking receiving portion in the course of assembling the container.

As a result, as shown in FIG. 6, the locking lug 47 gets over the locking receiving portion 23, and is rotated toward the cutout portion 27 while being brought into contact with a surface of the locking receiving portion 23. Due to such an operation, the locking piece 44 is moved inwardly between the side panels 13, 13.

Figure 7:
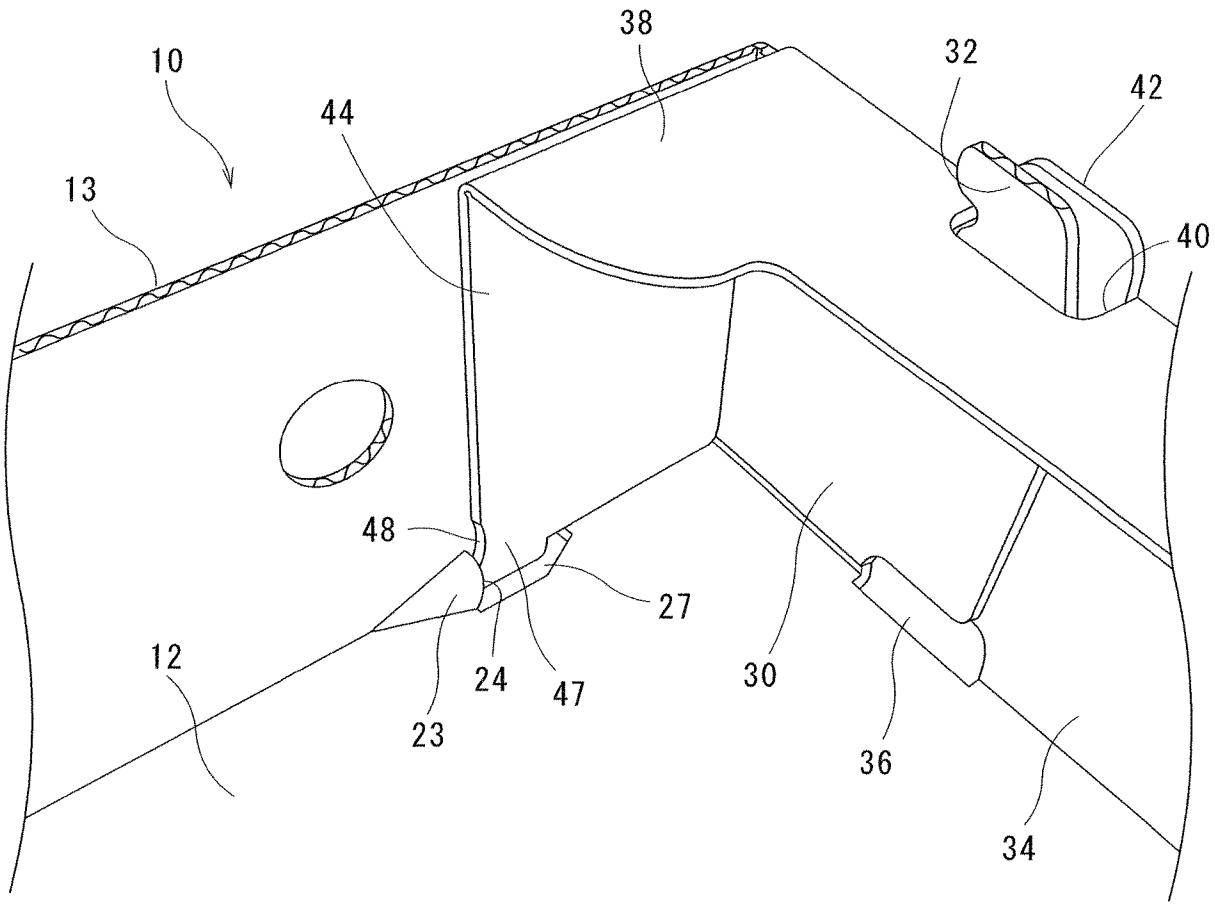
FIG. 7 is a partial enlarged perspective view showing the locking piece and the locking receiving portion in a state where the container is assembled.

Thereafter, as shown in FIG. 7, when the closure flap 38 is rotated to a horizontal position, the locking lug 47 gets over the locking receiving portion 23, the locking piece 44 is moved outwardly, and the locking lug 47 is made to fall into the cutout portion 27. Then, the locking recessed portion 48 is locked to a cut portion 24 side of the locking receiving portion 23. By performing such operations, the a raised state of the end panels 34 is maintained so that assembling of the tray 10 is completed.

As described above, when the tray 10 is assembled, the locking receiving portions 23 are stereoscopically raised against the bottom panel 12 and the side panels 13 so that the locking recessed portions 48 can be easily locked to the locking receiving portions 23. Further, by merely folding the closure flap 38 by pushing the closure flap 38 toward the bottom panel 12 and by rotating the locking pieces 44 along the side panels 13, the locking recessed portions 48 can be locked to the locking receiving portions 23 and hence, assembling operability can be enhanced with a simple configuration. Further, in locking the locking lugs 47 to the locking receiving portions 23 by rotating the locking pieces 44, the locking lugs 47 are made to fall into the cutout portions 27 and hence, it is possible to prevent the locking lugs 47 from interfering with the bottom panel 12 whereby the locking recessed portions 48 can be easily locked to the locking receiving portions 23.

Second Embodiment

Figure 8:
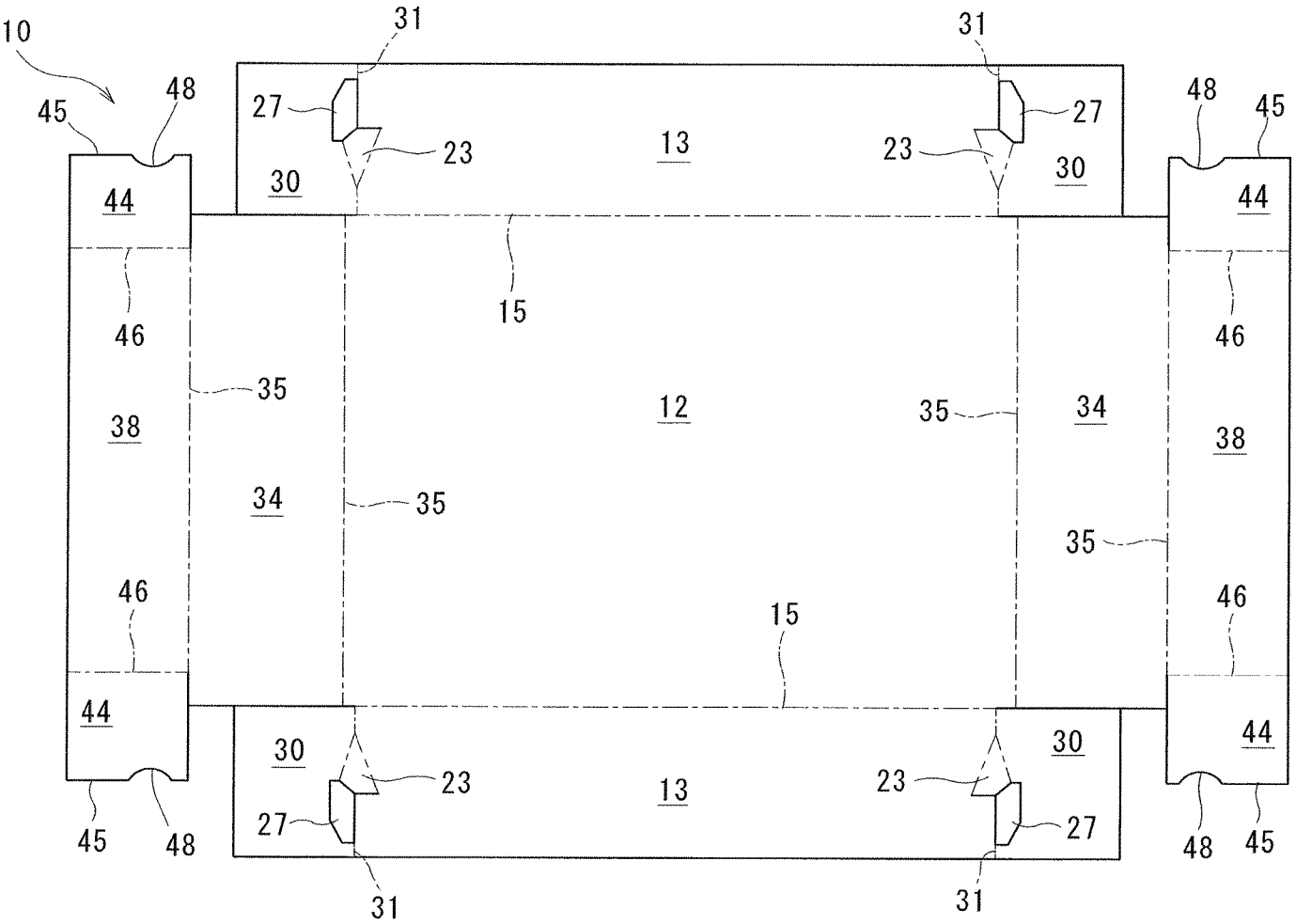
FIG. 8 is a developed view of a container according to a second embodiment.

FIG. 8 shows a tray 10 of a second embodiment. Elements identical to those the trays 10 of the first embodiment are given the same symbols, and the description of such elements is omitted. The tray 10 of this embodiment differs from the tray 10 of the first embodiment in that locking receiving portion 23 and cutout portions 27 are formed on each boundary portion between a side panel 13 and a folding flap 30. In the second embodiment, the folding flap 30 corresponds to the first panel, the side panel 13 corresponds to the second panel, and a locking piece 44 corresponds to the third panel. A locking recessed portion 48 is formed on an outer end edge 45 of each locking piece 44. In the second embodiment, the cutout portions 27 may not be formed.

In the second embodiment, the side panels 13 are folded against a bottom panel 12, and the folding flaps 30 are folded against the side panels 13. Due to such operations, each locking receiving portion 23 is raised so as to be inclined between the side panel 13 and the folding flap 30. Then, the end panels 34 are folded against the bottom panel 12 and, thereafter, closure flaps 38 are folded against the end panels 34 in a state where the locking pieces 44 are folded against the closure flaps 38 so that the tray 10 is assembled. By assembling the tray 10 in this manner, the outer end edge 45 of each locking piece 44 is arranged at an intermediate position between an upper end and a lower end of the side panel 13 along an inner surface of the side panel 13. In such a state, the locking receiving portion 23 and the locking recessed portion 48 are locked to each other. Accordingly, the tray 10 of this embodiment can achieve similar operation and advantageous effects as the tray 10 of the first embodiment.

Third Embodiment

Figure 9:
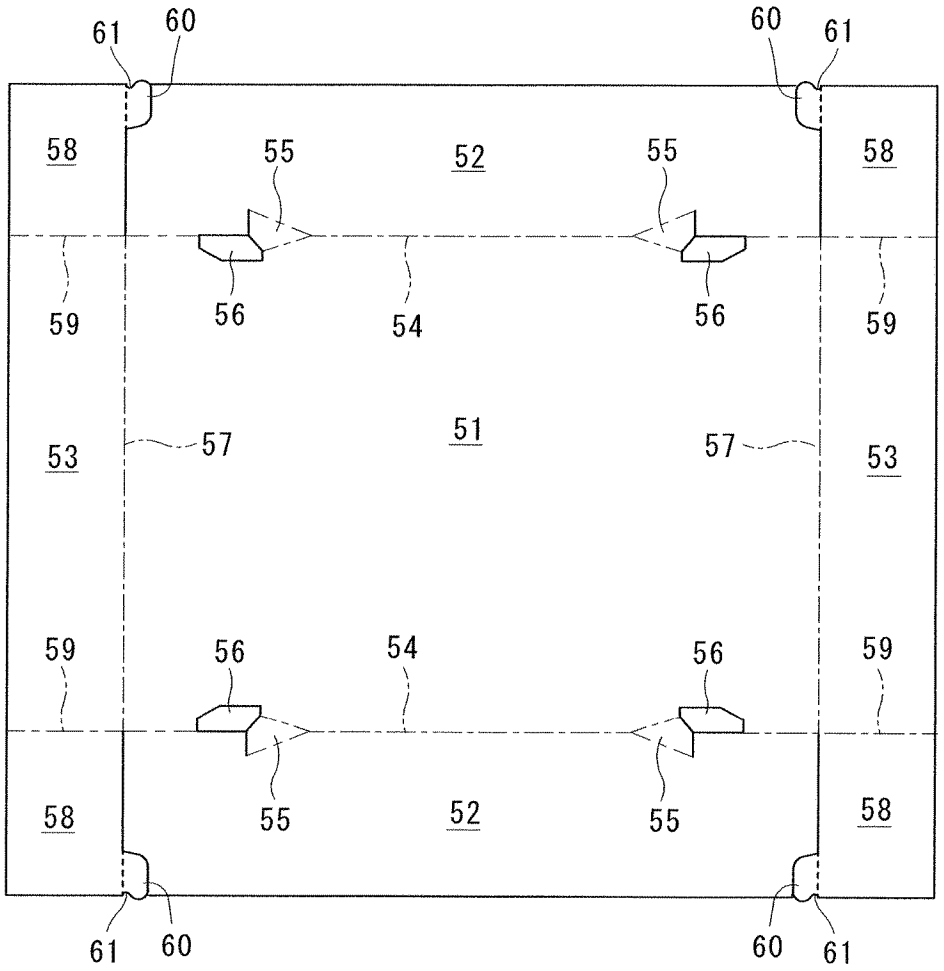
FIG. 9 is a developed view of a container according to a third embodiment.

FIG. 9 shows a tray 50 of a third embodiment. In the tray 50, side panels (second panels) 52 are connected to long sides of a bottom panel (first panel) 51, and end panels 53 are connected to short sides of the bottom panel 51. Locking receiving portions 55, cutout portions 56, and a side-panel fold line (first fold line) 54 are formed on each boundary portion between the bottom panel 51 and the side panel 52. An end-panel fold line (second fold line) 57 is formed on each boundary portion between the bottom panel 51 and the end panel 53. Rectangular locking pieces (third panels) 58 are connected to outer edges of the end panel 53. A locking-piece fold line 59 is formed on each boundary portion between the locking piece 58 and the end panel 53. A locking lug 60 projecting toward the side panel 52 is formed on an inner corner portion of each locking piece 58, and a locking recessed portion 61 is formed between the locking lug 60 and an outer end edge of the locking piece 58.

In assembling the tray 50, the side panels 52 are folded so as to raise the side panels 52 against the bottom panel 51. By folding the side panels 52 in such a manner, the locking receiving portions 55 are stereoscopically raised against the bottom panel 51 and the side panels 52. Then, the locking pieces 58 are folded against the end panels 53 and, thereafter, the end panels 53 are folded so as to raise the end panels 53 against the bottom panel 12. Specifically, while bringing the locking pieces 58 into slide contact with inner surfaces of the side panels 52, each end panel 53 is rotated to a raised state about an end-panel fold line 57 by pushing the end panel 53. Due to such an operation, each locking lug 60 is rotated toward the locking receiving portion 55, and the locking recessed portion 61 is locked to the locking receiving portion 55 so that the tray 50 is assembled. Accordingly, the tray 50 of the third embodiment having such a configuration can achieve similar operation and advantageous effects as the tray 10 of the first embodiment.

Fourth Embodiment

Figure 10:
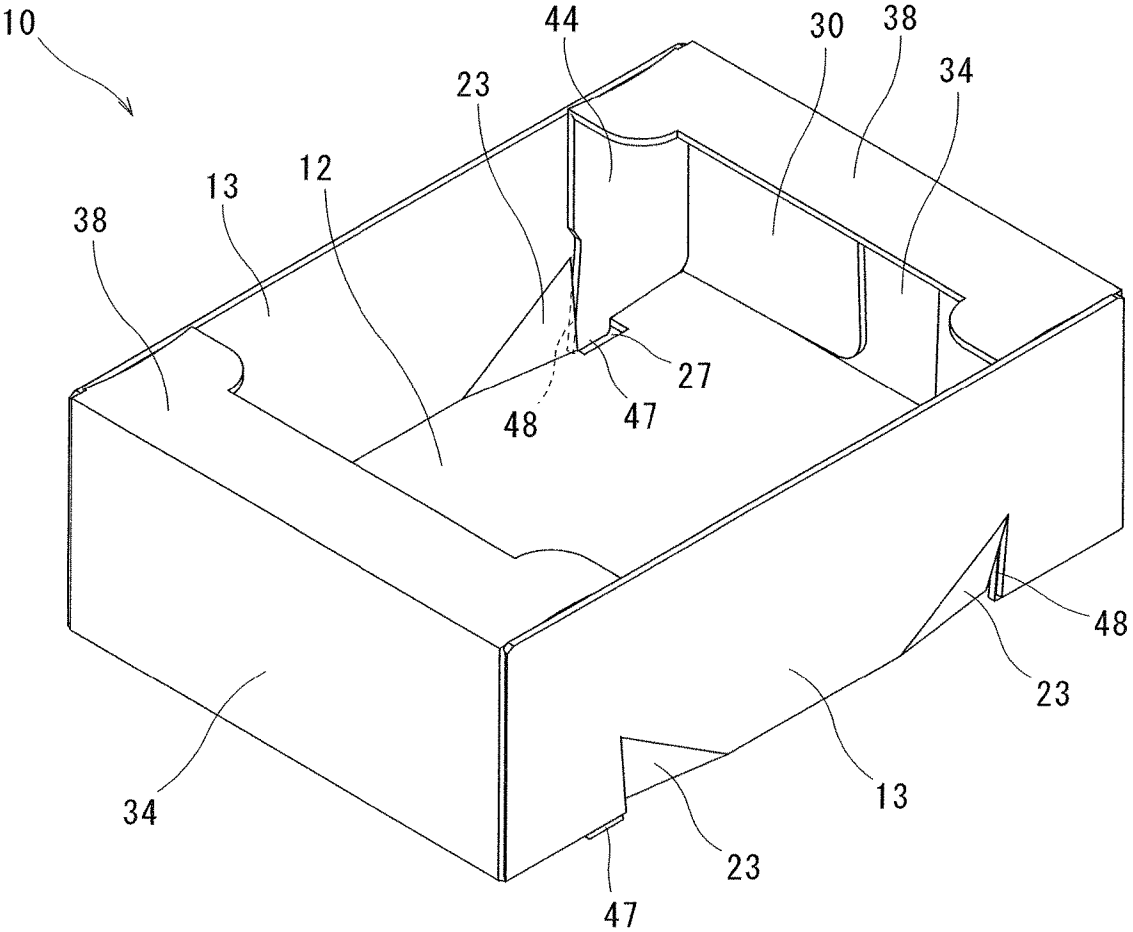
FIG. 10 is a perspective view of a container according to a fourth embodiment.
Figure 11:
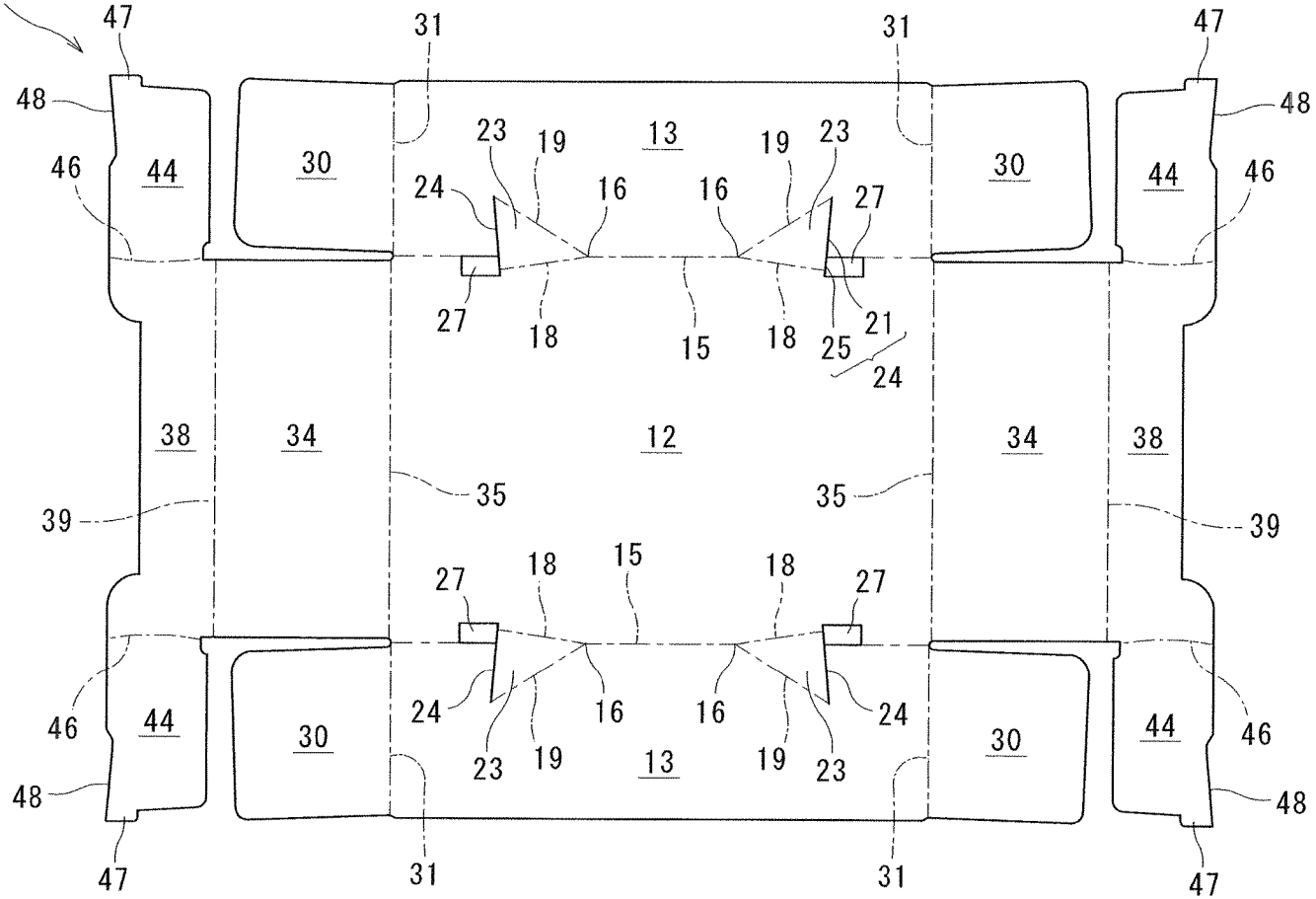
FIG. 11 is a developed view of the container in FIG. 10.
Figure 12:
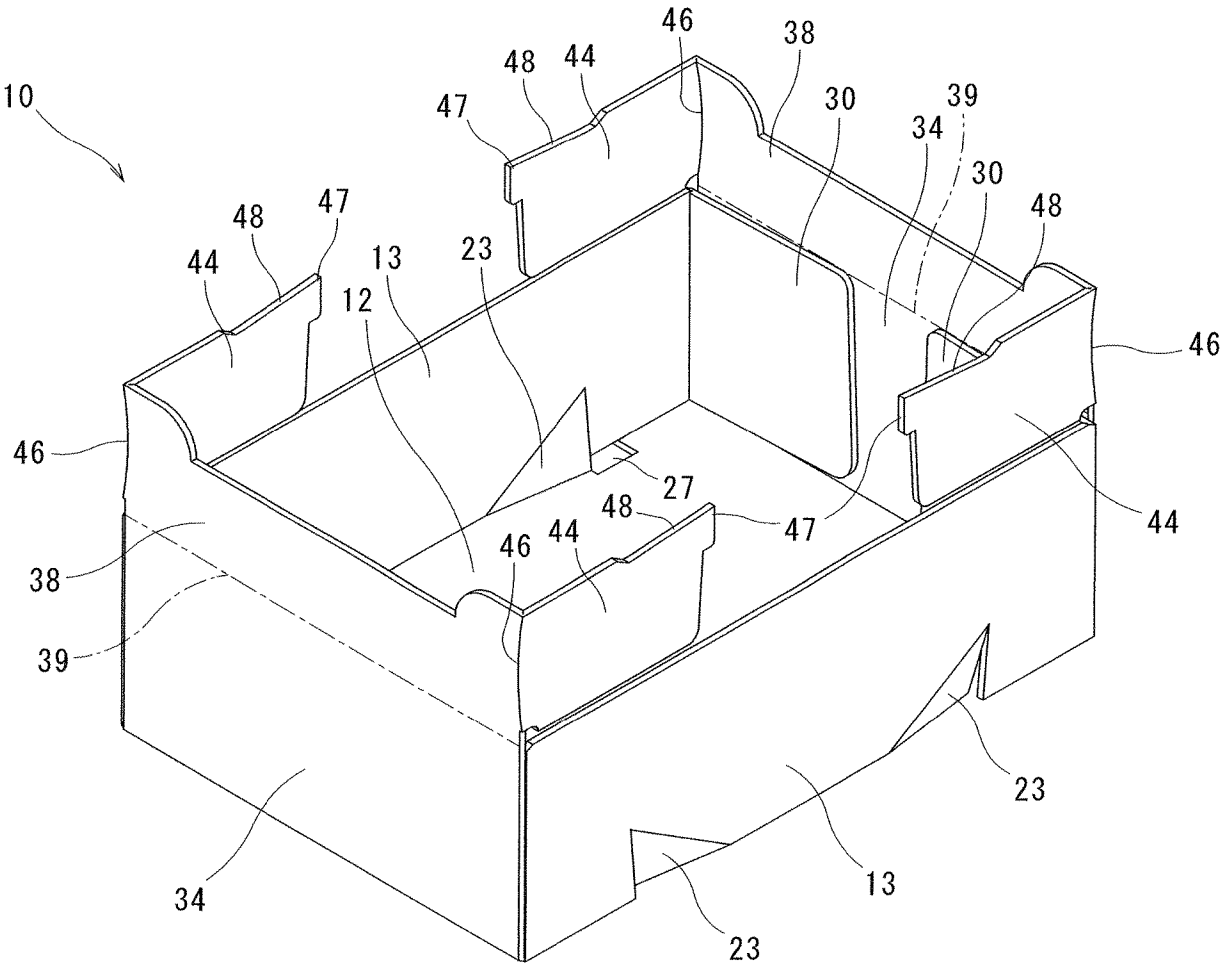
FIG. 12 is a perspective view showing the container in FIG. 10 in the course of assembling the container.

FIGS. 10 to 12 show a tray 10 of a fourth embodiment. As shown in FIGS. 10 and 11, the tray 10 of this embodiment largely differs from the tray 10 of the first embodiment in that stacking holes 36 and stacking projections 42 used for stacking the tray 10 and insertion lugs 32 and insertion holes 40 used for performing the positioning of the folding flaps 30 are not formed. Elements identical to the elements of the tray 10 of the first embodiment are given the same symbols, and the description of such elements is omitted.

A pair of locking receiving portions 23, 23 and a pair of cutout portions 27, 27 are formed on each boundary portion between a bottom panel (first panel) 12 and a side panel (second panel) 13, and a side-panel fold line (first fold line) 15 is formed on the boundary portion at positions excluding portions where the locking receiving portions 23, 23 and the cutout portions 27, 27 are formed. Out of these portions, the locking receiving portion 23 is formed so that a cut line 21 and a cutout edge 25 of a cut portion 24 which define an outer peripheral portion of the locking receiving portion 23 are linearly formed so that the locking receiving portion 23 has a triangular shape. Further, the cutout portion 27 is formed on a bottom panel 12 side along the side-panel fold line 15 so as to have a quadrangular shape.

A curved locking-piece fold line 46 which is bent (projects) toward a closure flap 38 side with a predetermined curvature is formed on each boundary portion between the closure flap 38 and a locking piece 44 (third panel). The formation of the locking-piece fold line 46 enhances an elastic restoring force by which the locking piece 44 is restored to a flat original shape when the locking piece 44 is folded against the closure flap 38. The configuration where the locking-piece fold line 46 is formed in a curved manner is applicable to the trays 10 of the first and second embodiments, and is also applicable to the locking-piece fold line 59 of the third embodiment.

Further, a locking lug 47 is formed on an outer corner portion of each locking piece 44, and a locking recessed portion 48 is formed on an outer end edge of each locking piece 44. The locking recessed portion (locking edge) 48 in this embodiment is linearly formed so that a corner portion of a distal end of the locking lug 47 positioned at a lower end in an assembled state projects the most toward a locking receiving portion 23 side, and the locking recessed portion 48 is inclined toward an upper outer side (end panel 34 side) from the corner portion of the distal end of the locking lug 47.

In assembling the tray 10, as shown in FIG. 12, the side panels 13 are folded against the bottom panel 12, and the folding flaps 30 are folded against the side panels 13. Next, the end panels 34 are folded against the bottom panel 12, and the locking pieces 44 are folded against the closure flaps 38. Thereafter, the closure flaps 38 are folded inwardly against the end panels 34 at closure-flap fold lines (second fold line) 39 so that the locking pieces 44 are positioned on inner surface sides of the side panels 13. Due to such operations, while each locking piece 44 is brought into slide contact with an inner surface of the side panel 13, the locking lug 47 is rotated toward the locking receiving portion 23, gets over an inner surface of the locking receiving portion 23, and is made to fall into the cutout portion 27. Then, the locking recessed portion 48 is locked to an edge of the cut portion 23 of the locking receiving portion 12. Accordingly, the tray 10 of this embodiment can achieve similar operation and advantageous effects as the tray 10 of the first embodiment.

Fifth Embodiment

Figure 13:
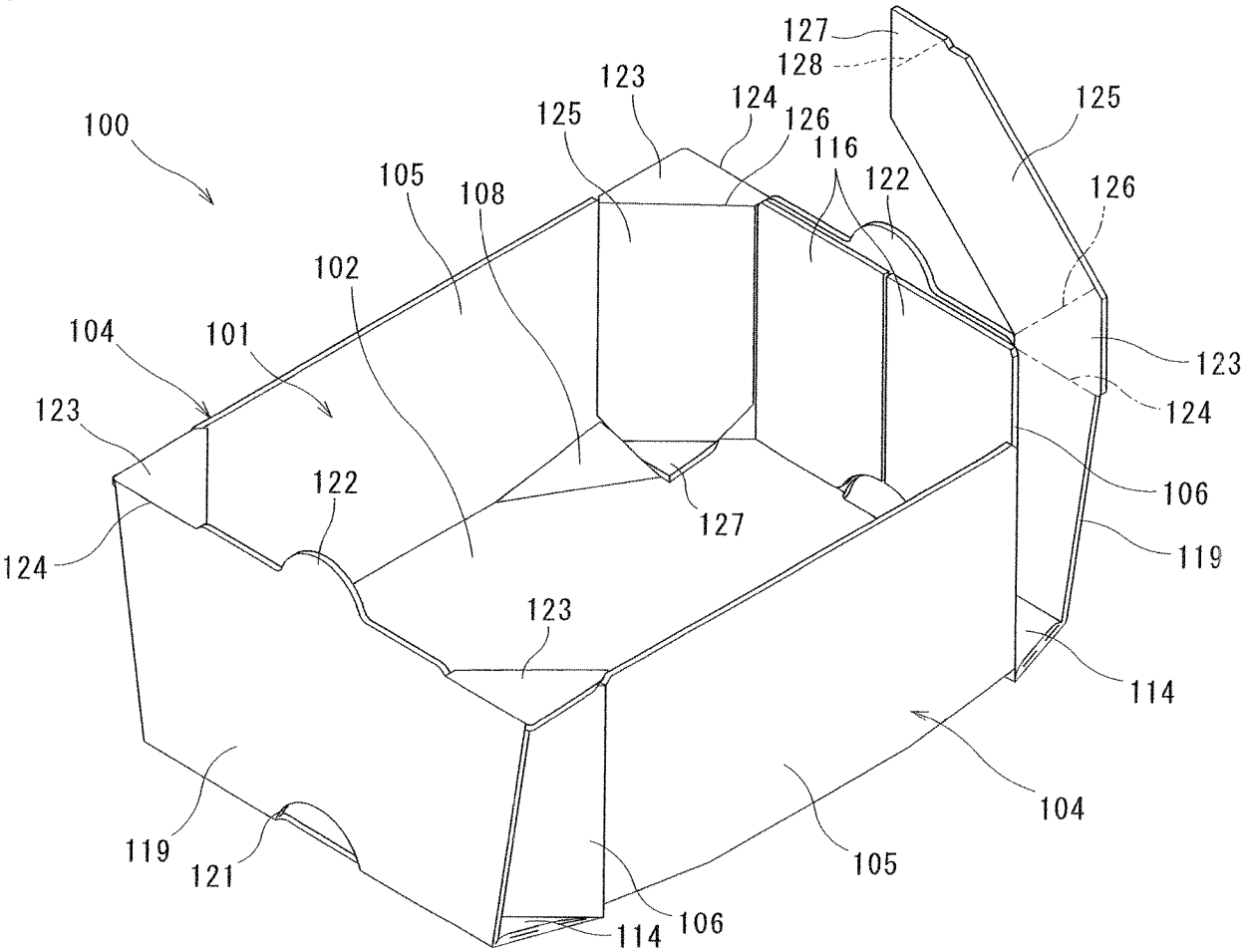
FIG. 13 is a perspective view of a container according to a fifth embodiment.
Figure 14:
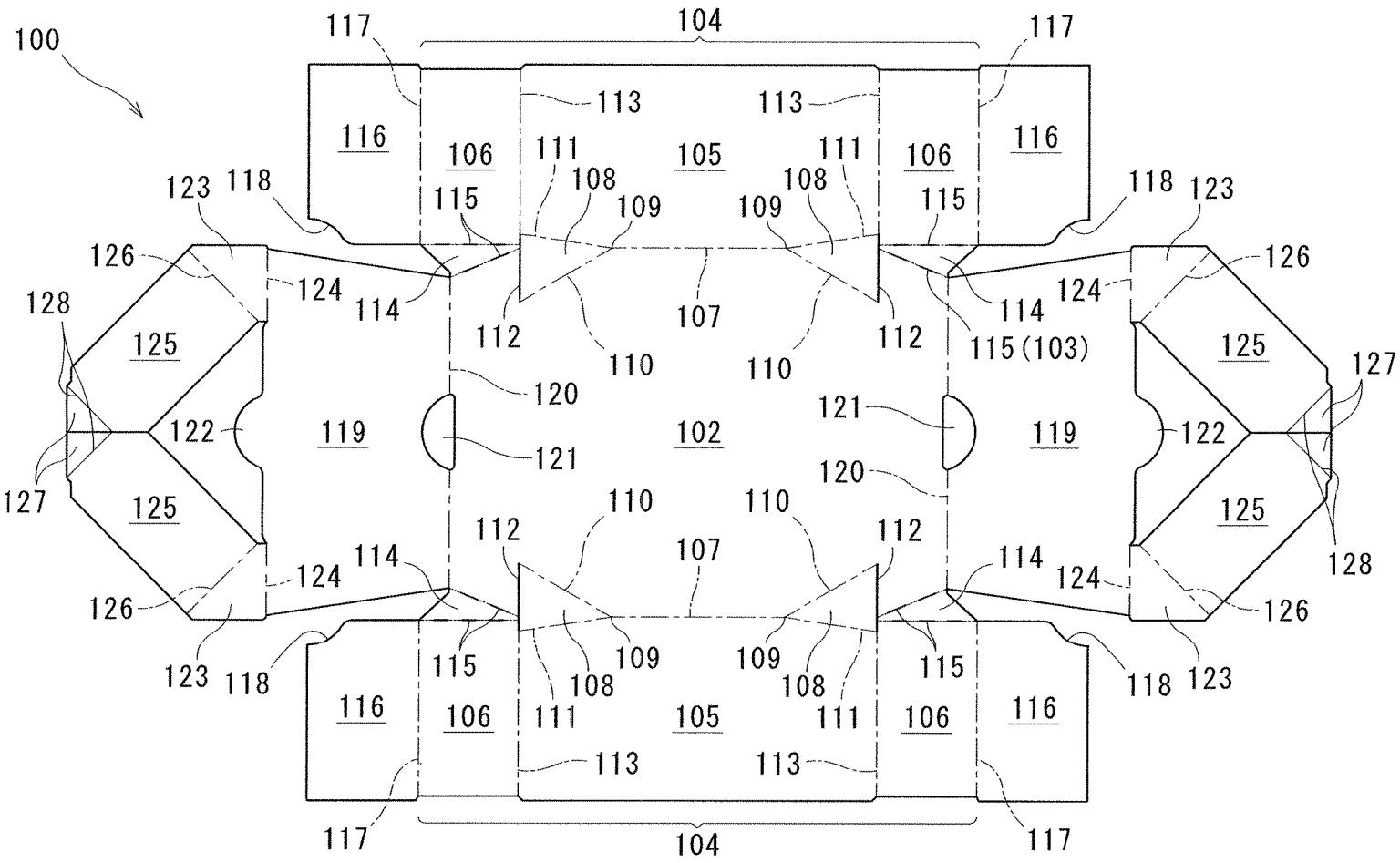
FIG. 14 is a developed view of the container in FIG. 13.

FIGS. 13 and 14 show a tray 100 of a fifth embodiment. In the tray 100, by providing inclined panel portions (corner portions) 106 to side panels 104, a storing portion 101 for storing articles which is surrounded by the side panel 104 and end panels 119 is formed into an octagonal shape as viewed in a plan view. This embodiment largely differs from the respective embodiments in that each closure flap 123 is formed so as to extend between the end panel 119 and the inclined panel portion 106 so that the closure flaps 123 are prevented from projecting into the inside of the storing portion 101.

As shown in FIG. 14, a blank for forming the tray 100 includes a bottom panel (first panel) 102 having an octagonal shape as viewed in a plan view where chamfered edges 103 are formed on corner portions. A pair of side panels (second panels) 104, 104 is connected to sides of the bottom panel 102 which include the chamfered edges 103 and is arranged opposite to each other. Each side panel 104 includes a side panel body 105 positioned at the center thereof as well as a pair of inclined panel portions 106, 106 positioned at both ends of the side panel body 105.

The side panel body 105 is connected to the bottom panel 102 between the chamfered edges 103, 103. A side-panel fold line (first fold line) 107 is formed on a boundary portion between the side panel body 105 and the bottom panel 102 at a portion excluding locking receiving portions 108. The locking receiving portion 108 has a bottom-panel-side inclined fold line (first inclined line) 110 extending on the bottom panel 102 from a branching point 109 on the side-panel fold line 107, a side-panel-side inclined fold line (second inclined line) 111 extending on the side panel 104, and a cut portion 112 extending between end portions of these fold lines 110, 111. The cut portion 112 in this embodiment is formed of a straight-line-shaped cut line. A cutout portion 27 arranged adjacently to the locking receiving portion 108 is not provided.

The inclined panel portion 106 has a rectangular shape, and a bending fold line 113 is formed on a boundary portion between the inclined panel portion 106 and the side panel body 105. The respective inclined fold lines 110, 111 are formed between the branching point 109 and the bending fold line 113, and the cut portion 112 is formed so as to be positioned on the same straight line as the bending fold line 113. A fold-back portion 114 having an approximately triangular shape is formed between an edge of the inclined panel portion 106 positioned on a lower side in an assembled state and the chamfered edge 103 of the bottom panel 102. The bottom panel 102 and the inclined panel portion 106 are connected to each other via the fold-back portion 114, and the fold-back portion 114 is made to overlap on the bottom panel 102 when the tray 100 is assembled so that the inclined panel portion 106 is bent against the side panel body 105 at an inclination angle of approximately 45 degrees. A fold-back-portion fold lines 115 for reducing an elastic restoring force generated due to the folding back of the panel is formed on a boundary portion (chamfered edge 103) between the fold-back portion 114 and the bottom panel 102 as well as on a boundary portion between the inclined panel portion 106 and the fold-back portion 114. The fold-back-portion fold lines 115 is formed of a lead score having fold lines which are formed by forming scores so as to reduce a panel thickness of the corrugated paper board by compression and cut lines formed at predetermined intervals.

A folding flap 116 which is arranged on an inner surface of the end panel 119 is formed on an end edge of each inclined panel portion 106 of the side panel 104, and a folding-flap fold line 117 is formed on a boundary portion between the folding flap 116 and the inclined panel portion 106. An arcuate notched portion 118 which corresponds to a stacking hole 121 for stacking the tray 100 is formed on the folding flap 116.

A pair of end panels 119, 119 is connected to other sides of the bottom panel 102 which are arranged opposite to each other. Each end panel 119 is formed into a trapezoidal shape where a lateral width is gradually increased from a proximal end positioned between the chamfered edges 103, 103 of the bottom panel 102 toward a distal end positioned on an upper side in the assembled state. A stacking hole 121 and an end-panel fold line 120 are formed on a boundary portion between the end panel 119 and the bottom panel 102. The stacking hole 121 is a semicircular hole which is formed in the end panel 119 and extends to the end panel 119 over the end-panel fold line 120. Further, a stacking projection 122 for stacking the tray 100 is integrally formed on the center of the distal end of the end panel 119 in a projecting manner. The stacking projections 122 are fitted in stacking holes 121 of another tray 100 stacked on the tray 100.

A pair of closure flaps 123, 123 having a right-angled triangular shape is connected to both sides of the distal end of each end panel 119, and a closure-flap fold line (second fold line) 124 is formed on a boundary portion between the closure flap 123 and end panel 119. The closure flap 123 covers an area above the fold-back portion 114 in the assembled state, and an inner edge (locking-piece fold line 126 described later) of the closure flap 123 is positioned along an upper side of the inclined panel portion 106 of the side panel 104. The closure flaps 123 cover portions of upper ends formed by the side panels 104 and the end panels 119 (outer sides of an opening) so that an external appearance of the tray 100 in the assembled state becomes an approximately rectangular shape as viewed in a plan view.

A locking piece (third panel) 125 arranged along the inner surface of the inclined panel portion 106 in the assembled state is connected to the inner edge of each closure flap 123, and the locking-piece fold line 126 is formed on a boundary portion between the locking piece 125 and the closure flap 123. The locking piece 125 has an approximately quadrangular shape, and a locking lug 127 is connected to a distal end of the locking piece 125 positioned at a lower end in the assembled state. The locking lug 127 has a right-angled triangular shape, and a locking-lug fold line 128 is formed on a boundary portion between the locking lug 127 and the locking piece 125. The locking-lug fold line 128 is formed of an inverted score line which is formed by forming scores from a front liner side of the corrugated paper board so as to reduce the panel thickness of the corrugated paper board by compression. By locking edges (locking portions) of the locking lugs 127 to edges of cut portions 112 of the locking receiving portions 108 raised from the bottom panel 102, the tray 100 can be maintained in an assembled state.

In assembling the tray 100, as shown in FIG. 13, while the inclined panel portions 106 are folded against the side panel body 105, the side panels 104 are folded against the bottom panel 102, and the folding flaps 116 are folded against the side panels 104 (inclined panel portions 106). Due to such operations, the fold-back portions 114 are folded together with these panels so as to overlap on the bottom panel 102, and the inclined panel portions 106 are raised from inner ends of the fold-back portions 114. Next, the end panels 119 are folded against the bottom panel 102 and, thereafter, the locking pieces 125 are folded inwardly against the closure flaps 123, and, each closure flap 123 is folded inwardly against the end panel 119 about the closure flap-fold line 124. Then, each locking piece 125 is rotated toward the inclined panel portion 106 of the side panel 104, and the locking lug 127 formed on the distal end of the locking piece 125 is brought into contact with the bottom panel 102 so that the locking lugs 127 are folded against the locking pieces 125. When the locking pieces 125 are made to overlap with the inclined panel portions 106, edges of the locking lugs 127 are locked to edges of the cut portions 112 of the locking receiving portions 108.

When the tray 100 of the fifth embodiment is assembled in the same manner as the first embodiment, the locking receiving portions 108 are stereoscopically raised against the bottom panel 102 and the side panels 104 so that the locking lugs 127 can be easily locked to the locking receiving portions 108 by merely folding the locking pieces 125. Accordingly, assembling operability can be enhanced. Further, the closure flaps 123 are respectively arranged at four corner portions and hence, the trays 100 can be stacked to each other in a stable state. The side panels 104 and the end panels 119 which form outer peripheral panels define an octagonal shape as viewed in a plan view and hence, compressive strength of the tray 100 in the vertical direction can be enhanced. Further, the closure flaps 123 do not project inwardly so as to cover portions of the storing portion 101 and hence, storing and taking out of articles can be easily performed. In the case of the trays 100 of the first, second, and fourth embodiments where the closure flaps 123 project inwardly from the upper end opening of the tray 100, at the time of taking out articles (fruits and vegetables, for example) from the tray 100, it is necessary to cut and remove the closure flaps 123 by a knife such as a cutter knife. On the other hand, in the tray 100 of the fifth embodiment, such cutting operation is unnecessary.

The trays 10, 50, 100 of the present invention are not limited to the above-mentioned embodiments, and various modifications are conceivable.

Figure 18:
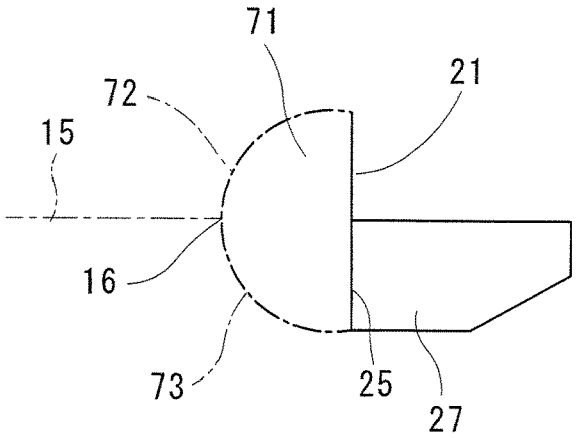
FIG. 18 is an enlarged front view showing a fourth modification of the locking receiving portion.

Specifically, an inclination angle of the bottom-panel-side inclined fold line (first inclined line) 18, 110 with respect to the side-panel fold line (first fold line) 15, 54, 107 and an inclination angle of the side-panel-side inclined fold line (second inclined line) 19, 111 with respect to the side-panel fold line (first fold line) 15, 54, 107 are not particularly limited. Further, in the above-mentioned embodiments, the bottom-panel-side inclined fold line 18, 110 and the side-panel-side inclined fold line 19, 111 are respectively formed of a straight line. However, the bottom-panel-side inclined fold line 18, 110 and the side-panel-side inclined fold line 19, 111 may be respectively formed of a curved line (see FIG. 18). Further, in the above-mentioned embodiments, the cut line 21 is formed of a straight line extending in the direction orthogonal to the side-panel fold line 15. However, a direction along which the cut line 21 extends is not limited provided that the cut line 21 extends toward the bottom panel 12, and the cut line 21 may be formed of a curved line. The cut line 21 in the above-mentioned embodiments is formed so as to extend from the end portion of the cutout edge 25 to the distal end of the side-panel-side inclined fold line 19. However, the cut line 21 may be formed so as to extend over a range from the end portion of the cutout edge 25 to the distal end of the side-panel-side inclined fold line 19 so as to provide play.

Figure 15:
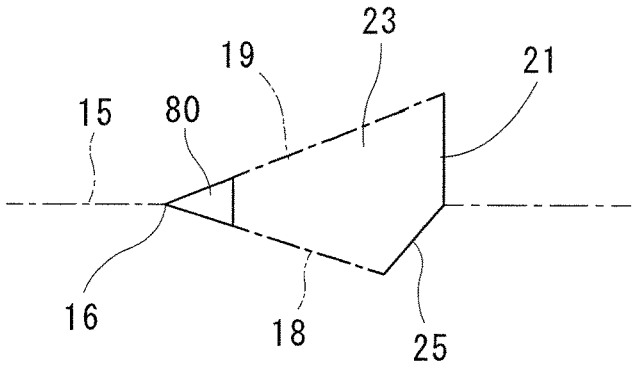
FIG. 15 is an enlarged front view showing a first modification of the locking receiving portion.
Figure 16:
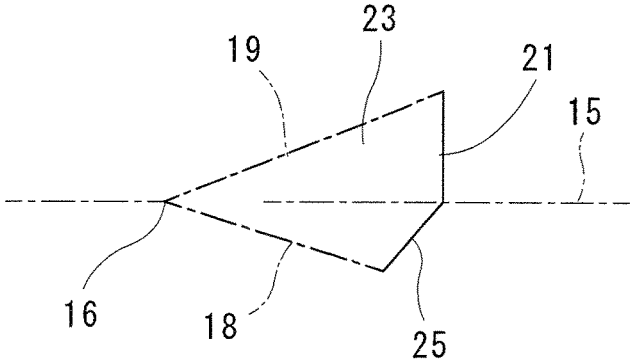
FIG. 16 is an enlarged front view showing a second modification of the locking receiving portion.

Further, with respect to the locking receiving portion 23, as in the case of a first modification shown in FIG. 15, a hole 80 having a triangular shape may be formed at a proximal end portion of the locking receiving portion 23 on a branching point 16, 109 side. By forming the hole 80, the locking receiving portion 23 can be easily folded against the bottom panel 12 and the side panel 13. As in the case of a second modification shown in FIG. 16, the side-panel fold line 15 may extend to the inside of the locking receiving portion 23. However, the side-panel fold line 15 is not formed so as to extend over the whole locking receiving portion 23, and a portion where the side-panel fold line 15 is not formed is left on a branching point 16, 109 side or on a cut portion 24, 112 side of the locking receiving portion 23.

Figure 17:
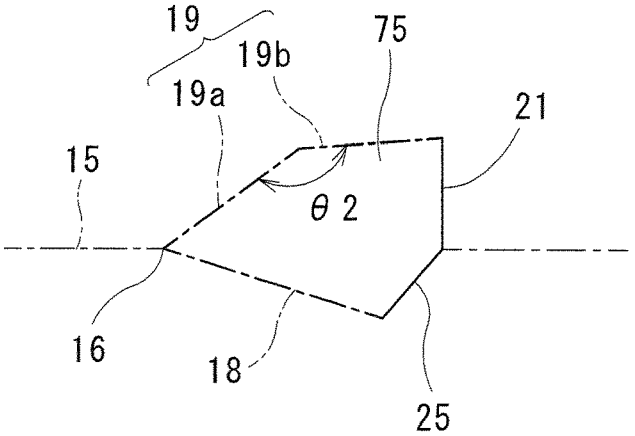
FIG. 17 is an enlarged front view showing a third modification of the locking receiving portion.

The locking receiving portion 23, 55 may be formed into a quadrangular shape as in the case of the first to third embodiments, or may be formed into a triangular shape as in the case of the fourth and fifth embodiments. Further, as in the case of a third modification shown in FIG. 17, the locking receiving portion 75 may be formed into a pentagonal shape. In this case, the side-panel-side inclined fold line 19 is formed of a first side-panel-side inclined fold line 19*a* extending from a branching point 16 in an inclined manner and a second side-panel-side inclined fold line 19*b* extending between a distal end of the first side-panel-side inclined fold line 19*a* and an end portion of a cut line 21. An angle θ2 formed between the first and second side-panel-side inclined fold lines 19*a*, 19*b* is set to an obtuse angle. That is, the side-panel-side inclined fold line (second inclined line) 19, 111 and the bottom-panel-side inclined fold line (first inclined line) 18, 110 is not necessarily formed of a single line, and may be formed as a combination of two lines. Further, as in the case of a fourth modification shown in FIG. 18, a locking receiving portion 71 may be formed into a semicircular shape. In this case, a side-panel-side inclined fold line (second inclined line) 72 and a bottom-panel-side inclined fold line (first inclined line) 73 are respectively formed of a curved line obtained by equally dividing a circular shape in four portions.

With respect to a cutout portion 27, provided that the cutout portion 27 is formed adjacently to the locking receiving portion 23, and a corner portion of the locking piece 44 is allowed to fall into the cutout portion 27, a shape and a size of the cutout portion 27 are not particularly limited. Further, provided that the locking recessed portion 48, 61 can be locked to the locking receiving portion 23, it is possible to adopt a configuration where the cutout portion 27 is not provided.

Figure 19:
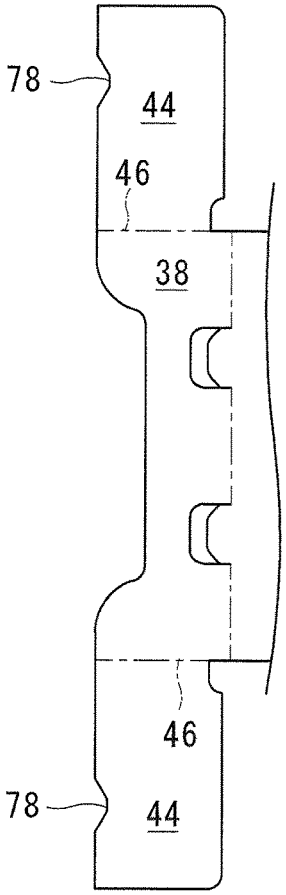
FIG. 19 is a partial enlarged developed view showing a fifth modification of the locking recessed portion.

In the above-mentioned embodiments, the locking lug 47 is formed so as to project from the corner portion of the locking piece 44. However, for example, as in the case of a fifth modification shown in FIG. 19, a locking recessed portion 78 which is recessed inwardly may be formed on an outer end edge of the locking piece 44 without forming the locking lug.

In the first to fourth embodiments, the tray 10, 50 is formed into a quadrangular shape as viewed in a plan view and, in the fifth embodiment, the tray 100 is formed into a quadrangular shape as viewed in a plan view and the storing portion 101 is formed into an octagonal shape as viewed in a plan view. However, as in the case of the fifth embodiment, an outer shape of the tray may also be formed into an octagonal shape as viewed in a plan view by providing the inclined panel portions 106. Further, provided that the pair of side panels and the pair of end panels are provided, the tray may be formed into a hexagonal shape as viewed in a plan view, and a shape of the tray as viewed in a plan view can be changed as desired.

In the above-mentioned embodiments, the tray 10, 50, 100 is formed using a corrugated paper board. However, the tray 10, 50, 100 may be formed by punching out a blank from a corrugated resin board. A material from which the blank is punched out is not limited to the corrugated board, and may be a single-layered heavy paper (cardboard) or a single-layered resin sheet.

In the above-mentioned embodiments, the description has been made by taking the tray 10, 50, 100 as an example of a container utilizing the locking structure of the present invention. However, the locking structure of the present invention may be utilized by other packing boxes. The application of the locking structure of the present invention is not limited to a container such as a tray or a packing box, and is also applicable to a product where a first panel and second panels are continuously formed, and it is necessary to lock the third panel to the second panel. Such modifications can also achieve similar operation and advantageous effects.

As described above, in the tray 10, 50, 100 utilizing the locking structure of the present invention, by folding the side panels (second panels) 13, 52, 104 against the bottom panel (first panel) 12, 51, 102, the locking receiving portions 23, 55, 108 are stereoscopically raised. Alternatively, by folding the folding flaps (first panel) 30 against the side panels (second panel) 13, the locking receiving portions 23 are stereoscopically raised. By merely arranging the locking pieces (third panel) 44, 58, 125 on the inner surface side of the side panels (second panels) 13, 52, 104 and by folding (rotating) the closure flaps 38, 123 or the end panels 53, the locking pieces 44, 58, 125 can be locked to the locking receiving portions 23, 55, 108. That is, a complex and high-accuracy positioning operation is unnecessary for assembling the tray and hence, automatic assembling of the container by an apparatus can be also realized.

Next, an automatic container assembling apparatus 200 for assembling the tray 10 is specifically described with reference to FIGS. 20 to 23. In this embodiment, the description is made by taking the tray 10 of the fourth embodiment as an example. However, provided that parts or the like of the automatic container assembling apparatus 200 are changed, the trays 10 of the first and second embodiments can be also automatically assembled in the same manner.

Figure 20:
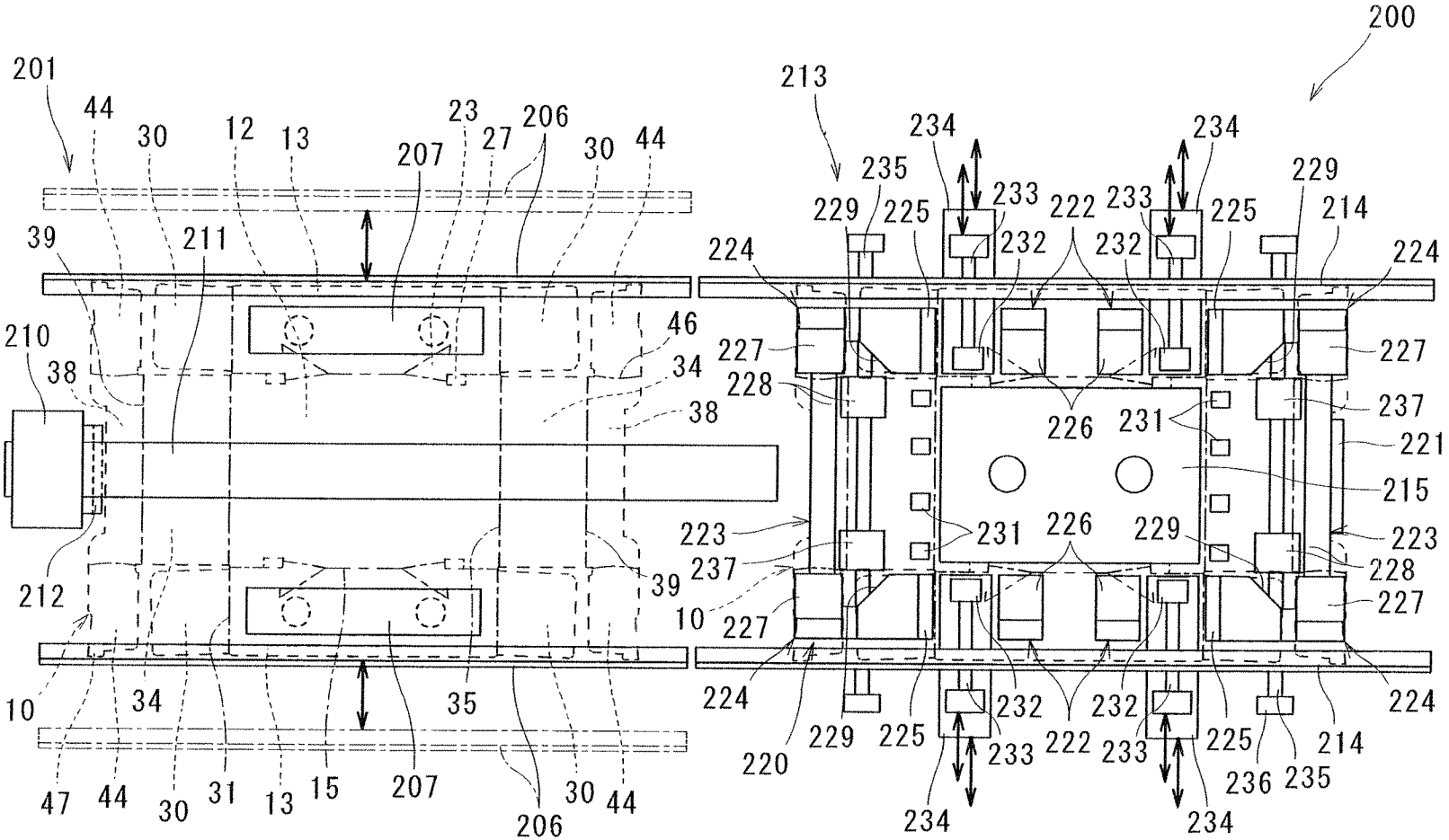
FIG. 20 is a plan view showing a full-automatic container assembling apparatus for automatically assembling a container.

As shown in FIG. 20, the automatic container assembling apparatus 200 includes a board supply apparatus 201 where punched-out blanks are arranged in a stacked state, and a container assembling apparatus 213 which assembles a container using one blank supplied from the board supply apparatus 201.

Figure 21:
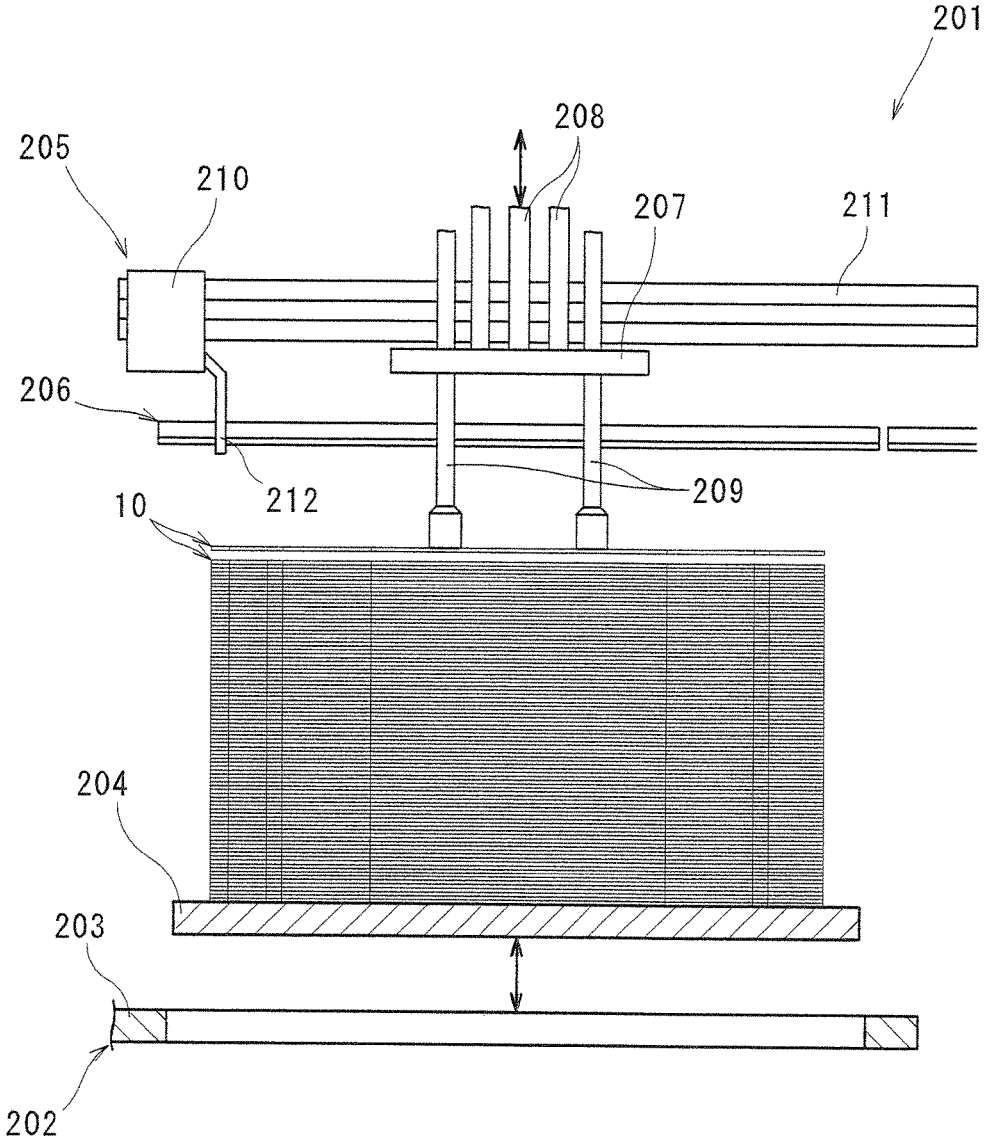
FIG. 21 is a side view showing a board supply apparatus in FIG. 20.

As shown in FIGS. 20 and 21, the board supply apparatus 201 includes a board feeding part 202 where flat blanks are arranged in a stacked state, and a conveying part 205 which conveys the blanks arranged in the board feeding part 202 to the container assembling apparatus 213.

The board feeding part 202 includes a conveying table 203 on which columnar rollers are mounted, and a lift part 204 which is movable in a vertical direction by means of a drive means such as a cylinder. The conveying table 203 moves the blanks arranged in the stacked state thereon to a lift part 204 at the same height position with the conveying table 203. The lift part 204 moves the supplied blanks to a board feeding position where the blanks can be taken out by means of the conveying part 205. The positioning of the blanks at the board feeding position is performed by a detection means such as a limit switch, for example.

The conveying part 205 includes a pair of first guide rails 206, 206 which supports both sides of the blank, a pair of takeout members 207, 207 by which the blank on the lift part 204 is arranged on the first guide rails 206, 206, and a transport member 210 which moves the blank arranged on the first guide rails 206 to the container assembling apparatus 213. The conveying part 205 is arranged above the board feeding part 202. The first guide rails 206, 206 have an L-like shape in cross section, and are arranged so that the first guide rails 206, 206 are movable by means of a drive means such as a cylinder in a direction orthogonal to a transport direction which is a direction extending toward a container assembling apparatus 213 side. Each takeout member 207 includes arm portions 208 extending upward and connected to a drive means such as a cylinder. A pair of suction members 209, 209 connected to a suction pump is mounted on the takeout member 207 in a downwardly projecting manner. The transport member 210 is movably mounted on a transport rail 211 disposed at the center between the first guide rails 206, 206 and above the first guide rails 206, 206. The transport member 210 can be advanced and retracted along the transport rail 211 by means of a motor. A pushing portion 212 is mounted on the transport member 210. The pushing portion 212 pushes one closure flap 38 which forms one end of the blank so as to move (or slide) a blank along the first guide rails 206.

After the first guide rails 206, 206 are brought into in a receiving state where the first guide rails 206, 206 are moved to the outside of a space indicated by one dot chain lines in FIG. 20, the conveying part 205 sucks one blank disposed at an upper most layer of the stacked blanks by means of the suction members 209 thus lifting the blank to a position above the first guide rails 206, 206. Next, after the first guide rails 206, 206 are brought into a transport state where the first guide rails 206, 206 are moved to the inside of the space indicated by bold lines shown in FIG. 20, the conveying part 205 releases the blank sucked by the suction members 209 thus arranging the blank on the first guide rails 206, 206. Thereafter, the blank is pushed by the transport member 210 along the first guide rails 206 so that the blank is moved to the container assembling apparatus 213. By repeating a series of these steps, the blank is supplied to the container assembling apparatus 213 one by one.

Figure 22:
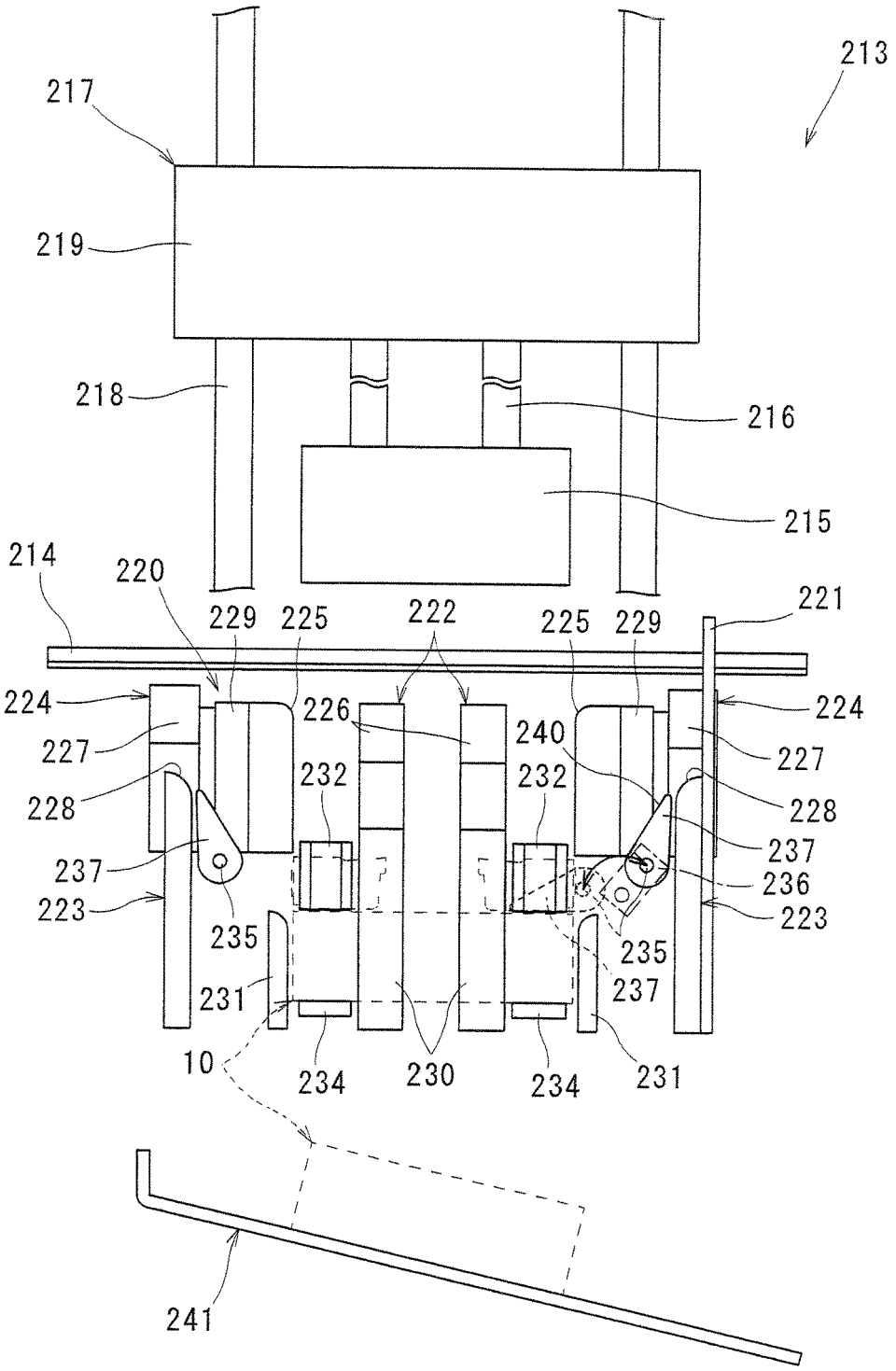
FIG. 22 is a cross-sectional view showing a container assembling apparatus in FIG. 20.

As shown in FIGS. 20 and 22, the container assembling apparatus 213 includes, a pair of second guide rails 214, 214, a pushing member 215, a guide frame 220, positioning members 232, receiving members 234, swing members 237, and a discharge chute 241. The container assembling apparatus 213 is disposed adjacently to the board supply apparatus 201. In the description hereinafter, a vertical direction along which the pushing member 215 is moved is referred to as a pushing direction, a direction which is a transport direction of a blank and is also a direction extending between the pair of end panels 34, 34 is referred to as a length direction, and a direction extending between a pair of side panels 13, 13 is referred to as a width direction.

The second guide rails 214 have an L-like shape in cross section, are fixed so as to be positioned on the same straight line as the first guide rails 206, 206 in the transport state, and receive a blank from the conveying part 205. It is preferable that a surface of each second guide rail 214 on which a blank is arranged is positioned below an arrangement surface of each first guide rail 206 thus preventing an end edge of the second guide rail 214 from interfering with the blank at the time of receiving the blank.

The pushing member 215 is formed of a block body where a lower end edge of the block body has substantially the same size as a bottom panel 12, and a lower end of the block body is opened. The pushing member 215 pushes the blank on the second guide rails 214, 214 in the downward direction which is a direction toward a guide frame 220. Mounting shafts 216 projecting upward are arranged on the pushing member 215, and the mounting shafts 216 are connected to an elevation unit 217. The elevation unit 217 includes, a pair of guide shafts 218, 218, and an elevation member 219 through which the guide shafts 218 are penetratingly inserted. An upper end of a connecting rod is pivotally mounted on the elevation member 219, and a lower end of the connecting rod is pivotally mounted to a crank member. Rotation of the crank member by means of a drive means lifts or lowers the elevation member 219 within a range predetermined by the connecting rod. Due to such lifting and lowering of the elevation member 219, the pushing member 215 is advanced or retracted between an outside area above the second guide rails 214 and an inside area in the guide frame 220 along the pushing direction.

The guide frame 220 is arranged below the second guide rails 214, and folds portions of the blank excluding the closure flaps 38 when the blank is downwardly pushed by the pushing member 215. The guide frame 220 includes a stopper 221 which projects upward to a position above the second guide rails 214, and stops the conveyed blank at a set position. Further, the guide frame 220 includes folding flap folding portions 225, side panel folding portions 226, locking piece folding portions 227, and end panel folding portions 228 as to be positioned at outer peripheral portions of the bottom panel 12. Specifically, as shown in FIG. 20, the guide frame 220 includes, first blocks 222 positioned below side panels 13, second blocks 223 positioned below the closure flaps 38, and third blocks 224 positioned below folding flaps 30 and locking piece 44. The folding portions 225 to 228 are respectively formed on the blocks 222 to 224.

Figure 23:
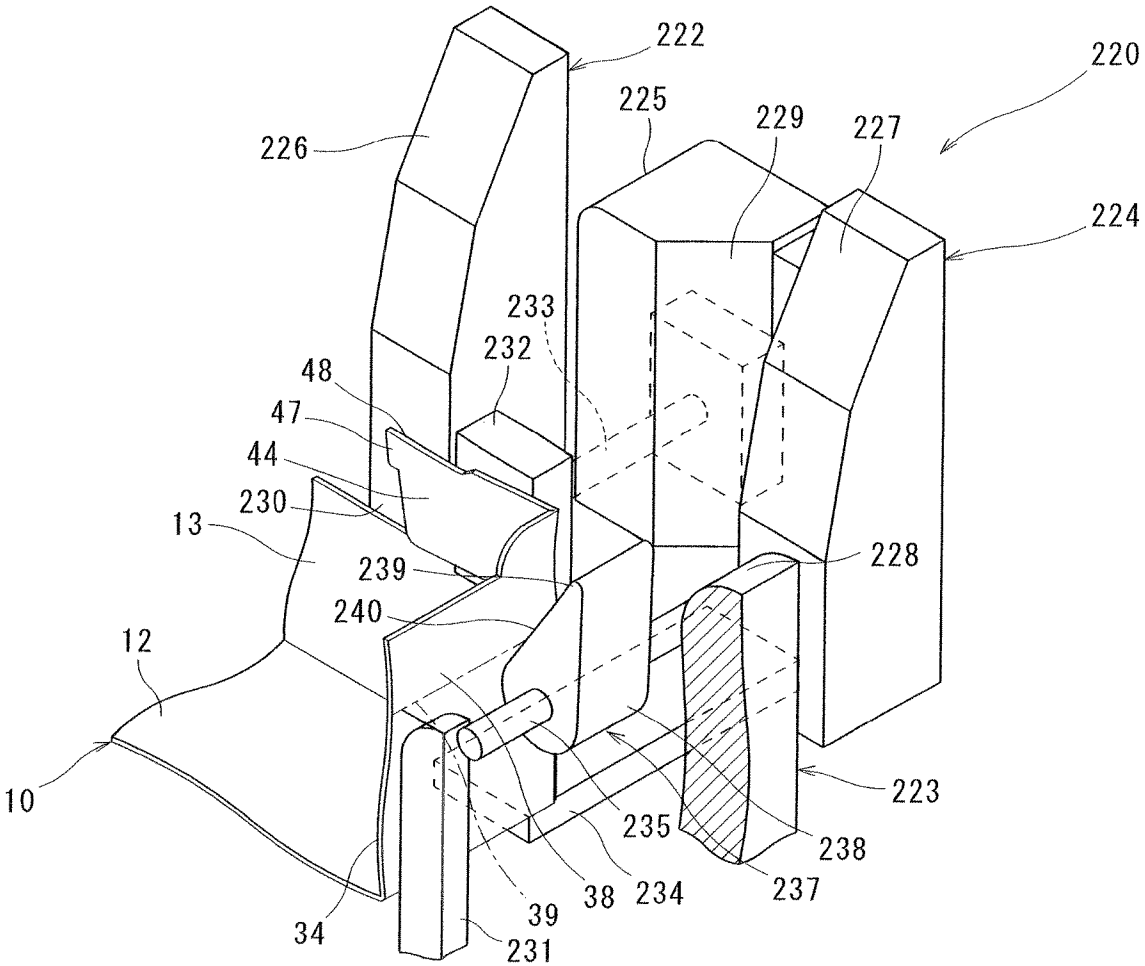
FIG. 23 is a perspective view showing a state where the positioning of a locking piece is performed.

As shown in FIGS. 22 and 23, each folding flap folding portion 225 is formed of a curved surface (round chamfered surface) formed at a corner portion of the third block 224 extending along the folding-flap fold line 31, and folds the folding flap 30 upwardly against the side panel 13. Each side panel folding portion 226 is formed of an inclined surface formed on an inner surface of the first block 222 extending along the side-panel fold line 15, and folds the side panel 13 upwardly against the bottom panel 12. Each locking piece folding portion 227 is formed of an inclined surface formed on an inner surface of the third block 224 extending along the locking-piece fold line 46, and folds the locking piece 44 upwardly against the closure flap 38. Each end panel folding portion 228 is formed of an upper end of the second block 223 arranged so as to extend between the third blocks 224, 224 in the width direction, and folds the end panel 34 upwardly against the bottom panel 12. In this embodiment, arrangement positions (height) and inclination angles (or curvatures) of the respective folding portions 225 to 228 are set so that the folding flaps 30, the side panels 13, the locking pieces 44, and the end panels 34 are folded in this order.

Locking piece guide portions 229 are formed on the guide frame 220. The locking piece guide portions 229 guide the locking pieces 44 when the end panels 34 are folded against the bottom panel 12 and the locking pieces 44 are rotated together with the end panels 34, thereby causing the locking pieces 44 to be positioned parallel to the side panels 13. Each of the locking piece guide portion 229 is formed of an inclined surface formed on an inner surface side of the third block 224 disposed between the folding-flap folding portion 225 and the locking piece folding portion 227. Specifically, the locking piece guide portion 229 is formed so as to be inclined from an outer side to an inner side in the width direction from a locking piece folding portion 227 side toward a folding-flap folding portion 225 side in the length direction.

The guide frame 220 further includes support portions 230, 231 for maintaining a state where the side panels 13 and the end panel 34 are folded against the bottom panel 12. The side panel support portion 230 is formed by downwardly extending a lower portion of the side panel folding portion 226 of the first block 222. The end panel support portion 231 is formed of a vertically extending strip-shaped member arranged to be positioned outside the end-panel fold line 31.

The positioning member 232 has a quadrangular columnar shape, and is arranged between the first block 222 having the side panel folding portion 226 and the third block 224. When the closure flap 38 is folded against the end panel 34, the positioning member 232 pushes the locking piece 44 inwardly so that the locking piece 44 is positioned on an inner surface side of the side panel 13. Specifically, in a pushed state where the blank is pushed into the guide frame 220 by the pushing member 215, the positioning member 232 is positioned outside the locking piece 44 in the width direction, and a lower end of the positioning member 232 is positioned above the side panel 13. A connecting shaft 233 extending outward in the width direction is connected to the positioning member 232 at one end, and the connecting shaft 233 is connected to a drive means such as a cylinder at the other end. Such a configuration enables the positioning member 232 to be moved inward and outward in the width direction.

The receiving member 234 has a plate shape. The receiving members 234 are arranged between the first block 222 having the side panel folding portion 226 and the third block 224 below the positioning member 232. At the time of folding the closure flap 38 against the end panel 34, the receiving members 234 advance beneath a bottom surface of the bottom panel 12 so that the bottom panel 12 is positioned and held. Specifically, the receiving member 234 can be positioned beneath a lower side of the bottom panel 112 when the blank is in the pushed state, and also can be positioned so that inner ends of the receiving members 234 being positioned on an outer side of the bottom panel 12 in the width direction. A drive means such as a cylinder is connected to an outer side of the receiving members 234 in the width direction so that the receiving members 234 can be moved inward and outward in the width direction. The receiving members 234 may be configured so that by connecting the receiving members 234 integrally with the positioning member 232 on the outer side of the receiving members 234 in the width direction, the receiving members 234 and the positioning members 232 can be advanced and retracted by one drive means.

The swing member 237 is arranged between the second block 223 having the end panel folding portion 228 and the end panel support portion 231 in a movable manner along the length direction of the tray 10, and folds the closure flap 38 inwardly against the end panel 34. Specifically, the swing member 237 is fixed to a swing shaft 235 arranged so as to extend in the width direction. A crank member 236 is arranged at both ends of the swing shaft 235, and the crank member 236 is rotated by means of a motor. Due to such rotation of the crank member 236, the swing shaft 235 is swung in the length direction from an area in the vicinity of the second block 223 to an area in the vicinity of the end panel support portion 231. The swing member 237 has a wedge shape where a panel thickness of the swing member 237 is gradually reduced from a columnar proximal portion 238 fixed to the swing shaft 235 to a distal end of the swing member 237. Before the swing member 237 is operated, that is, when a blank is in a non-folded state where the swing shaft 235 is positioned on a second block 223 side, a tapered distal end portion 239 is positioned on an upper side, and a contact surface 240 disposed on an inner side in the length direction is inclined downwardly from the outer side toward the inside of the guide frame 220. After the swing member 237 is operated, that is, when the blank is in a folded state where the swing shaft 235 is positioned on an end panel support portion 231 side, a distal end portion 239 is positioned on an inner side in the length direction, and the contact surface 240 is positioned on a lower side so as to press the closure flap 38.

The discharge chute 241 is a member having a plate shape. The discharge chute 241 is arranged below the guide frame 220 at a predetermined angle, and an assembled tray 10 is discharged to the outside the container assembling apparatus 213 through the discharge chute 241.

Next, the manner of operation of a assembling apparatus is specifically described.

When a blank for the tray 10 is supplied to the second guide rails 214 from the board supply apparatus 201, the blank is stopped by the stopper 221 at a predetermined position on the second guide rails 214. Then, the pushing member 215 is moved downward and is brought into contact with a bottom panel 12 of the blank on the guide rails. When the pushing member 215 is further moved downward, the blank is elastically deformed so that the blank is removed from the guide rails and falls onto the guide frame 220 from the guide rails.

When the pushing member 215 is further moved downward, folding flaps 30 of the blank are folded against side panels 13 by the folding-flap folding portions 225 and, at the same time, locking pieces 44 of the blank are folded against end panels 34 by the locking piece folding portions 227. Next, the side panels 13 are folded against the bottom panel 12 by the side panel folding portions 226 and, thereafter, the end panels 34 are folded against the bottom panel 12 by the end panel folding portions 228. At the time of folding the end panels 34, the locking pieces 44 which are folded prior to the folding of the end panels 34 are guided so as to be positioned parallel to the side panels 13 by the locking piece guide portions 229.

After the blank is pushed by the pushing member 215 so as to become such a pushed state, the pushing member 215 is moved upward. In such a pushed state, as shown in FIG. 22, outer sides of the side panels 13 and outer sides of the end panel 34 are respectively supported by the support portions 230, 231 of the guide frame 220 so that the tray 10 maintains a state shown in FIG. 12. In such a state, each locking piece 44 is positioned above an upper end of the side panel 13, and a locking lug 47 side of a distal end of the locking piece 44 is brought into pressure contact with an inner surface of the first block 222 due to an elastic restoring force of the blank. Accordingly, supposed to that each closure flap 38 is folded against the end panel 34 in such a state, the locking pieces 44 interfere with the side panels 13 thus obstructing a folding operation.

Next, in this embodiment, as shown in FIG. 23, the receiving members 234 are moved inward in the width direction so that a bottom surface of the bottom panel 12 is positioned and held on the receiving members 234. Then, the positioning members 232 are moved inward in the width direction so that the positioning members 232 positions the locking piece 44 more on an inner surface side than the side panel 13 by pushing. In such a state, the swing members 237 are swung toward an inner side in the length direction.

When the swing members 237 are swung, the contact surfaces 240 are brought into contact with the closure flap 38 thus pushing the closure flap 38 so that the closure flap 38 is folded against the end panel 34. Along with the folding of the closure flap 38, the locking pieces 44 connected to the closure flap 38 are integrally rotated along inner surfaces of the side panels 13. At this stage of operation, each locking piece 44 is positioned more on the inner surface side than the side panel 13 by the positioning members 232 and hence, there is no possibility that the locking pieces 44 obstruct the folding operation by interfering with an upper end of the side panel 13 at the beginning of the swing of the swing members 237.

As shown in FIG. 10, when the closure flaps 38 are rotated to a position where each closure flap 38 extends in a direction perpendicular to the end panel 34 due to the swing of the swing members 237, the positioning of the locking pieces 44 performed by the positioning members 232 is released. Accordingly, the locking pieces 44 are brought into close contact with the side panels 13 due to an elastic restoring force, and each locking recessed portion 48 on a distal end side of the locking piece 44 is locked to a locking receiving portion 23 raised between the bottom panel 15 and the side panel 13.

After the tray 10 is automatically assembled in this manner, the swing members 237 are moved outward in the length direction to a non-operated position and, at the same time, the positioning members 232 and the receiving members 234 are moved outward in the width direction. In such a state, the pushing member 215 is moved downward, and then the assembling of a next tray 10 using a blank is started. Alternatively, in a state where a blank for forming the next tray 10 is not arranged, the pushing member 215 is moved downward. Due to such operations, with respect to the tray 10 which is assembled prior to the next tray 10, a bottom panel 12 of the next tray 10 or the pushing member 215 per se positioned above the tray 10 is brought into contact with the crosspiece panels 38 so that the crosspiece panels 38 are pushed downward and hence, the tray 10 is discharged to the outside of the container assembling apparatus 213 through the discharge chute 241.

As described above, the container assembling apparatus 213 of the present invention includes the positioning members 232 for performing the positioning of the locking pieces 44 and hence, it is possible to prevent the occurrence of a state where the locking piece 44 interferes with the end edge of the side panel 13 and cannot be arranged on an inner surface side of the side panel 13 due to an action of an elastic restoring force. Further, at the time of folding the closure flap 38 against the end panel 34, the receiving members 234 receive the bottom panel 12 of the tray 10 and hence, it is possible to prevent the tray 10 from being moved due to a force generated by the swing members 237. Further, when the closure flaps 38 are rotated by the swing members 237, a distal end of each locking piece 44 is arranged on the inner surface side of the side panel 13 and, thereafter, the positioning of the locking piece 44 by the positioning member 232 is released. When the locking piece 44 is rotated to a predetermined position, the locking piece 44 is locked. Accordingly, the tray 10 can be automatically assembled with certainty.

The configuration of the container assembling apparatus 213 of the present invention is not limited to the configuration in the above-mentioned embodiment, and various modifications are conceivable.

For example, the configurations of the guide frame 220 for folding the side panels 13, the folding flaps 30, the end panels 34 and the locking pieces 44 are not limited to the above-mentioned configurations, and various modifications are conceivable. Further, the tray 10 which can be automatically assembled by the container assembling apparatus 213 is not limited to the trays 10 having the configurations described in the respective embodiments where each closure flaps 38 extends between the pair of side panels 13, 13. It is also possible to automatically assemble the tray 10 by the container assembling apparatus 213 even when the tray 10 adopts the configuration described in the fifth embodiment where each closure flap 38 is provided to a corner portion between the side panel 13 and the end panel 34. Further, although the description is made using the tray 10 of the fourth embodiment which does not include a stacking projection 42 for stacking the tray 10, the tray 10 which includes the stacking projections 42 as described in the first embodiment can be also automatically assembled by the container assembling apparatus 213. Further, it is possible to make the swing member 237 perform both a function of folding the closure flap 38 against the end panel 34 and a function of folding the end panel 34 against the bottom panel 12. By adopting such a configuration, the number of parts can be reduced.

DESCRIPTION OF SYMBOLS

10 tray (container)
12 bottom panel (first panel)
13 side panel (second panel)
15 side-panel fold line (first fold line)
16 branching point
18 bottom-panel-side inclined fold line (first inclined line)
19 side-panel-side inclined fold line (second inclined line)
23 locking receiving portion
24 cut portion
27 cutout portion
31 end-panel fold line
34 end panel
38 closure flap
39 closure-flap fold line (second fold line)
44 locking piece (third panel)
46 locking-piece fold line
47 locking lug
48 locking recessed portion (locking portion)
200 automatic container assembling apparatus
201 board supply apparatus
213 assembling apparatus
214 second guide rail
215 pushing member
220 guide frame
225 folding flap folding portion
226 side panel folding portion
227 locking piece folding portion
228 end panel folding portion
230 side panel support portion
231 end panel support portion
232 positioning member
234 receiving member
237 swing member
241 discharge chute

The invention claimed is:

1. A locking structure comprising:
a first panel;
a second panel formed continuously with the first panel and folded against the first panel;
a third panel arranged along an inner surface of the second panel;
a locking receiving portion defined by a first inclined line extending toward a third panel side on the first panel from a branching point on a fold line between the first panel and the second panel, a second inclined line extending toward the third panel side on the second panel from the branching point, and a cut portion extending between a distal end of the first inclined line and a distal end of the second inclined line, the locking receiving portion extending in an inclined manner between the first panel and the second panel in an assembled state; and
a locking lug projecting outward from the third panel in a longitudinal direction of the third panel and defining a locking recessed portion, the locking recessed portion being recessed in a width direction of the third panel,
wherein the locking lug is formed with a hook-shaped protruded portion arranged adjacent to the locking recessed portion and projecting outwardly in the longitudinal direction of the third panel, and
wherein the third panel is locked to the locking receiving portion at the locking recessed portion with the hook-shaped protruded portion being overlapped by the locking receiving portion by assembling the third panel so that the third panel extends along an inner surface of the second panel.

2. A container comprising:
a first panel;
a second panel formed continuously with the first panel and folded against the first panel; and
a third panel arranged along an inner surface of the second panel,
wherein the container further comprises:
a first inclined line extending toward a third panel side on the first panel from a branching point on a fold line between the first panel and the second panel, and inclined with respect to the fold line;
a second inclined line extending toward the third panel side on the second panel from the branching point and inclined with respect to the fold line;
a cut portion extending between a distal end of the first inclined line and a distal end of the second inclined line;
a locking receiving portion defined by the first inclined line, the second inclined line, and the cut portion, and extending in an inclined manner between the first panel and the second panel in an assembled state; and
a locking lug projecting outward from the third panel in a longitudinal direction of the third panel and defining a locking recessed portion, the locking recessed portion being recessed in a width direction of the third panel,
wherein the locking lug is formed with a hook-shaped protruded portion arranged adjacent to the locking recessed portion and projecting outwardly in the longitudinal direction of the third panel, and
wherein the third panel is locked to the locking receiving portion at the locking recessed portion with the hook-shaped protruded portion being overlapped by the locking receiving portion by assembling the third panel so that the third panel extends along an inner surface of the second panel.

3. The container according to claim 2, wherein the locking receiving portion defines a cutout portion, disposed adjacently to the cut portion side, into which a corner portion of the third panel falls at the time of assembling, and wherein a portion of the cut portion is formed by an edge of the cutout portion.

4. The container according to claim 3, wherein the container comprises:
a bottom panel which forms the first panel;
a pair of side panels which forms the second panel connected to two sides of the bottom panel arranged opposite to each other;
a pair of end panels connected to two other sides of the bottom panel arranged opposite to each other;
a closure flap connected to the end panels and covering a portion of an upper end formed of the side panels and the end panels in an assembled state; and
a locking piece formed of the third panel and connected to the closure flaps, and
wherein the locking piece is arranged on an inner surface of the side panel by folding the closure flap against the end panel in a state that the locking piece is folded against the closure flap, and the locking portion is locked by rotating the locking portion toward a cut portion side of the locking receiving portion.

5. The container according to claim 3, wherein the cut portion includes a cut line that is formed on the third panel and connects the distal end of the second inclined line and the cutout portion.

6. The container according to claim 5, wherein the cut line extends substantially perpendicularly with a fold line between the first and second walls.

7. The container according to claim 2, wherein the container further comprises:

a bottom panel which forms the first panel;

a pair of side panels which forms the second panel connected to two sides of the bottom panel arranged opposite to each other;

a pair of end panels connected to two other sides of the bottom panel arranged opposite to each other;

a closure flap connected to the end panels and covering a portion of an upper end formed of the side panels and the end panels in an assembled state; and a locking piece formed of the third panel and connected to the closure flaps, and wherein the locking piece is arranged on an inner surface of the side panel by folding the closure flap against the end panel in a state that the locking piece is folded against the closure flap, and the locking portion is locked by rotating the locking portion toward a cut portion side of the locking receiving portion.

* * * * *